US005183062A

United States Patent [19]

Clearman et al.

[11] Patent Number: 5,183,062

[45] Date of Patent: Feb. 2, 1993

[54] CIGARETTE

[75] Inventors: Jack F. Clearman, Blakely, Ga.; Billy T. Conner, Winston-Salem, N.C.

[73] Assignee: R. J. Reynolds Tobacco Company, Winston-Salem, N.C.

[21] Appl. No.: 873,529

[22] Filed: Apr. 21, 1992

Related U.S. Application Data

[63] Continuation of Ser. No. 642,233, Jan. 12, 1991, which is a continuation-in-part of Ser. No. 488,516, Feb. 27, 1990, Pat. No. 5,027,837.

[51] Int. Cl.[5] ..... A24F 1/22

[52] U.S. Cl. ..... 131/194; 131/335; 131/359; 131/361

[58] Field of Search ..... 131/336, 361, 194, 195, 131/196, 359, 335

[56] References Cited

U.S. PATENT DOCUMENTS

| | | | |
|---|---|---|---|
| 2,164,702 | 7/1939 | Davidson . | |
| 3,313,305 | 8/1965 | Noznick et al. . | |
| 4,236,532 | 12/1980 | Schweizer et al. | 131/335 |
| 4,854,331 | 8/1989 | Banerjee et al. . | |
| 4,903,714 | 2/1990 | Barnes et al. . | |
| 4,924,888 | 5/1990 | Perfetti et al. . | |
| 5,019,122 | 5/1991 | Clearman et al. . | |
| 5,027,837 | 7/1991 | Clearman et al. | 131/359 |

FOREIGN PATENT DOCUMENTS

| | | |
|---|---|---|
| 342538 | 12/1989 | European Pat. Off. . |
| 0352109 | 1/1990 | European Pat. Off. . |

*Primary Examiner*—Theatrice Brown
*Assistant Examiner*—J. Doyle
*Attorney, Agent, or Firm*—Grover M. Myers; David G. Conlin; August J. Borschke

[57] ABSTRACT

A cigarette includes a longitudinally segmented combustible fuel element, and a substrate carrying tobacco extract and glycerin positioned physically separate from the fuel element. The substrate is a gathered paper-type material, and is positioned in a spaced apart relationship from the fuel element. The fuel element is composed of a carbonaceous material and is extruded in such a manner that when positioned within the cigarette, its extrusion axis is perpendicular to the longitudinal axis of the cigarette. The fuel element includes a burning segment at one end, a base segment at the opposite end, and an isolation segment between the burning and base segments. The fuel element is circumscribed by glass fibers so as to hold the fuel element in place within the cigarette.

80 Claims, 7 Drawing Sheets

CIGARETTE

CROSS-REFERENCE TO RELATED APPLICATION

This is a continuation of copending application(s) Ser. No. 07/642,233 filed on Jan. 23, 1991, which is a continuation-in-part of U.S. patent application Ser. No. 488,516, filed Feb. 27, 1990, now U.S. Pat. No. 5,027,837.

BACKGROUND OF THE INVENTION

The present invention relates to smoking articles such as cigarettes, and in particular, to those smoking articles having a heat source and a physically separate aerosol generating means. Such smoking articles include a combustible fuel element, which upon use, is capable of producing heat which is transferred to the aerosol generating means for resultant aerosol production. Such smoking articles are capable of providing the smoker with the pleasures of smoking (e.g., smoking taste, feel, satisfaction, and the like), by heating, but not necessarily burning, tobacco in various forms. In addition, such smoking articles are capable of providing very low yields of mainstream carbon monoxide.

Cigarettes, cigars and pipes are popular smoking articles which use tobacco in various forms. Many smoking products have been proposed as improvements upon, or alternatives to, the various popular smoking articles. For example, numerous references have proposed articles which generate flavored vapor and/or visible aerosol. Most of such articles have employed a combustible fuel source to provide an aerosol and/or to heat an aerosol forming material. See, for example, the background art cited in U.S. Pat. No. 4,714,082 to Banerjee et al.

Smoking articles which are capable of providing the pleasures associated with cigarette smoking, by heating but not necessarily burning tobacco, and without delivering considerable quantities of incomplete combustion products, are described in U.S. Pat. Nos. 4,714,082 to Banerjee et al; 4,756,318 to Clearman et al; 4,793,365 to Sensabaugh, Jr. et al; 4,819,665 to Roberts et al; 4,854,311 to Banerjee et al and 4,881,556 to Clearman et al; and European Patent Application No. 342,538. Such smoking articles employ a combustible fuel element for heat generation; and aerosol forming substances positioned physically separate from, and in a heat exchange relationship with, the fuel element. During use, heat generated by the fuel element acts to volatilize the aerosol forming substances, thereby providing a visible aerosol. Such smoking articles provide for extremely low yields of visible sidestream smoke as well as low yields of FTC "tar".

It would be desirable to provide a cigarette including a fuel element and a physically separate aerosol generating means; which cigarette (i) is capable of providing substantial quantities of volatilized tobacco components, (ii) makes efficient use of heat generated by the fuel element for aerosol formation, and (iii) is capable of providing very low yields of mainstream carbon monoxide.

SUMMARY OF THE INVENTION

The present invention relates to cigarettes and other smoking articles which include a fuel element (i.e., a heat source) positioned in a heat exchange relationship with a physically separate aerosol generating means. In a highly preferred smoking article, the composition and configuration of the fuel element, as well as the positioning of the fuel element within the smoking article, are such that very efficient use is made of the heat generated by that fuel element. As such, in a preferred smoking article, a high proportion of the heat produced by a burning fuel element is exchanged to the aerosol generating means for aerosol generation. The smoking articles of the present invention also incorporate tobacco of some form.

In one aspect, a preferred smoking article of the present invention includes (i) an extruded combustible fuel element or heat source positioned within the smoking article such that the extrusion axis of the fuel element is substantially perpendicular to the longitudinal axis of the smoking article; (ii) a physically separate aerosol generating means including at least one aerosol forming material; and (iii) means for securing, maintaining or retaining the fuel element within the smoking article.

In another aspect, a preferred smoking article of the present invention includes (i) a longitudinally segmented combustible fuel element; (ii) a physically separate aerosol generating means including at least one aerosol forming material; (iii) means for securing, maintaining or retaining the fuel element within the smoking article; and (iv) means for enclosing at least a portion of the longitudinal periphery of the fuel element so as to limit the amount of atmospheric oxygen which contacts the fuel element when the fuel element burns during use (i.e., an enclosure member). Typically, the enclosure member is capable of transferring heat from the burning fuel element to the aerosol generating means.

The smoking article, in one aspect, includes a short, preferably carbonaceous, combustible fuel element or heat source. Typically, the fuel element is of a longitudinally segmented design such that only a segment or portion of the length thereof is available for burning, and a segment or portion of the length thereof serves as a base which allows the fuel element to be secured in place within the smoking article. A preferred fuel element includes an isolation segment or portion positioned between the burning and base portions thereof. The preferred isolation segment has both a cross sectional periphery and cross sectional area which are smaller than that of the base segment. The preferred isolation segment has a cross sectional area, and in certain circumstances a cross sectional periphery, which are smaller than that of the burning segment.

A typical fuel element has a total length, prior to burning, of less than about 20 mm, and the length of the portion available for burning is less than about 15 mm. Preferred fuel elements are provided by subdividing a continuous extrudate into lengths, and employed such that extrusion axis of the fuel element is substantially perpendicular to the longitudinal axis of the smoking article into which the fuel element is incorporated.

In certain aspects of the present invention, the fuel element includes at least one void space extending therethrough in a direction transverse to the longitudinal axis of the smoking article into which the fuel element is incorporated. In other aspects of the present invention, the fuel element includes at least one airflow passageway (e.g., at least one void space) extending therethrough in a directional parallel to the longitudinal axis of the smoking article into which the fuel element is incorporated; and the airflow passageway can extend through the central region of the fuel element and/or as grooves along the periphery of the fuel element.

The smoking article includes a retaining means for maintaining the fuel element in position therewithin. The retaining means contacts the fuel element and secures the fuel element in position within the smoking article. In one preferred embodiment, a retaining member grasps the base of the fuel element, thereby serving to hold the fuel element securely in place. In another preferred embodiment, the retaining means is provided by a fibrous material (e.g., glass fibers or a tobacco filler/glass fiber mixture), gathered or shredded tobacco paper, gathered or shredded carbon paper or tobacco cut filler which contacts a significant length of the longitudinal periphery of the fuel element; and the longitudinally segmented nature of the fuel element in combination with the contact of the circumscribing material with the longitudinal periphery of the fuel element provides for the maintenance of that fuel element securely in place within the fibrous material, paper or tobacco cut filler.

The smoking article includes an aerosol generating means physically separate from, and longitudinally disposed from, the fuel element. The aerosol generating means includes a substrate and at least one aerosol forming material. A preferred aerosol generating means includes an aerosol forming material, such as tobacco of some form (e.g., densified tobacco pellets, tobacco extract or tobacco dust) and other aerosol forming materials (e.g., glycerin and/or tobacco flavoring agents, such as cocoa, licorice and sugars). The aerosol forming material generally is carried by a substrate, such as gathered paper, gathered tobacco paper, or a heat stable substrate (e.g., alumina beads). When the substrate is a paper-type material, it is highly preferred that such substrate be positioned in a spaced apart relationship with the fuel element.

The smoking article, in one aspect, includes an enclosure member, which preferably is a heat conducting member for transferring heat generated by the burning portion of the fuel element to the aerosol generating means. As such, the conducting member is in a heat exchange relationship, and preferably is in a conductive heat exchange relationship, with the substrate which carries the aerosol forming material. The enclosure member is radially spaced from the longitudinal periphery of the fuel element. Normally, the enclosure member contacts (i) a portion of the aerosol generating means, and (ii) a portion of the retaining member. Preferably, the enclosure member is radially spaced from the longitudinal outer periphery of the fuel element, at least a portion of the length of the burning portion of the fuel element, and contacts the aerosol generating means. As such, the fuel element and the enclosure member define an airflow passageway, and air drawn through the passageway is heated.

The fuel element is thermally isolated from other portions or components of the smoking article. By this is meant that the burning portion of the fuel element experiences controlled heat loss (i.e., heat sinking), particularly as a result of conductive heat transfer, to other portions or components of the smoking article. Thermal isolation of the fuel element is desirable, particularly during periods of smolder when the smoking article is not being drawn upon, in order that the fuel element does not self-extinguish as a result of heat sinking to other portions of the smoking article.

A preferred smoking article includes a mouthend piece for delivering aerosol to the mouth of the smoker. Typically, the mouthend piece has a generally tubular shape, and contains a roll of tobacco cut filler and a filter element.

As used herein, the term "aerosol" is meant to include vapors, gases, particles, and the like, both visible and invisible, and especially those components perceived by the smoker to be "smoke-like," formed by the action of heat generated by the fuel element upon materials contained within the aerosol generating means, or elsewhere in the smoking article.

As used herein, the term "carbonaceous" means comprising primarily carbon.

DETAILED DESCRIPTION OF THE PREFERRED EMBODIMENTS

Figure 1:
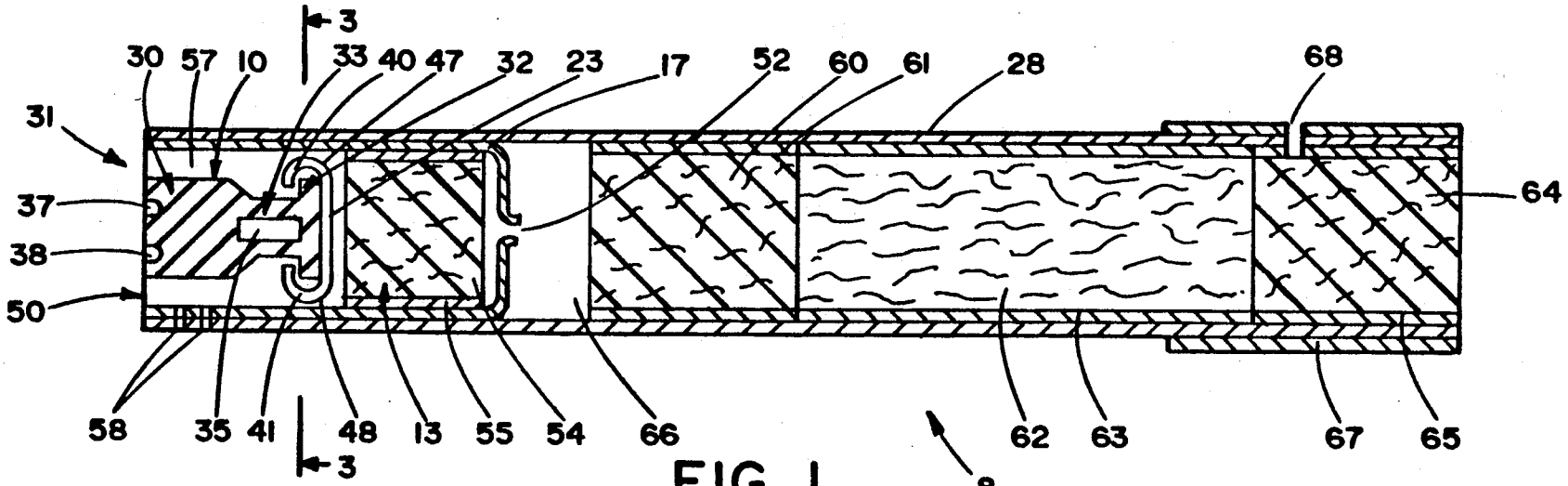
FIG. 1 is a longitudinal sectional view of a cigarette of the present invention.
Figure 2:
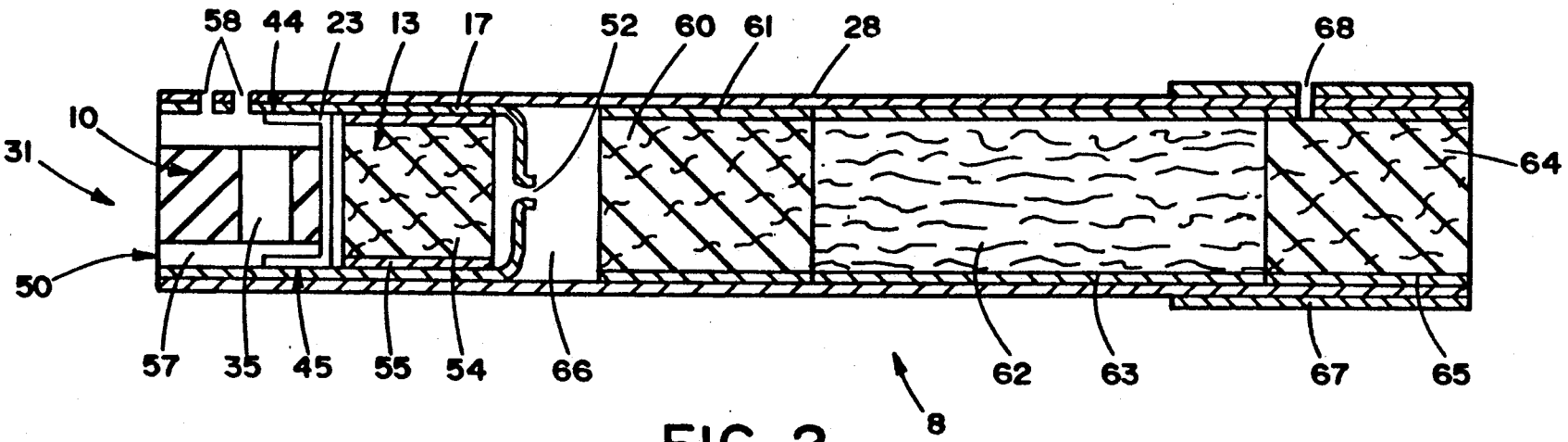
FIG. 2 is a longitudinal sectional view of the cigarette illustrated in FIG. 1, but rotated 90° about the longitudinal axis of the cigarette.

Referring to FIGS. 1 and 2, an embodiment of the present invention has the form of a cigarette 8. The cigarette includes a heat source or fuel element 10; a substrate 13 which carries aerosol forming material and which is positioned behind the fuel element; an enclosure member 17 which contains the substrate and is radially spaced around the longitudinal periphery of the fuel element; a retaining member 23 which holds the fuel element securely in place within the cigarette; and a tubular mouthend piece 28. A typical cigarette has a generally circular cross section and a circumference of about 20 mm to about 28 mm, and a length of about 70 mm to about 100 mm.

The heat source or fuel element 10, which preferably is an extruded carbonaceous material, has a generally square or rectangular cross sectional design. The preferred fuel element is a segmented fuel element which includes three longitudinally positioned portions or segments (as shown in FIG. 1); a burning portion 30 positioned near the extreme lighting end 31 of the cigarette, a base or supporting portion 32 at the opposite end (i.e., mouth end) of the fuel element, and an isolation portion 33 positioned between the burning and base portions. The fuel element 10 is configured so that (i) the cross sectional periphery of the base portion 32 is greater than the cross sectional periphery of the isolation portion, and (ii) the isolation portion includes at least one void space 35, which extends transversely through the fuel element. The void space acts to reduce the cross sectional area of the isolation portion, and as such, acts to minimize conduction of heat from the burning portion 30 to the base portion 33. In particular, void space 35 acts to assist in (i) providing separation of the burning and base segments, (ii) providing for a selected length over which the fuel element effectively burns, and (iii) minimizing conduction of heat from the burning portion of the fuel element through the base portion of the fuel element to other regions of the cigarette. The fuel element 10 includes optional ribbed grooves 37, 38 extending across the foremost face of the burning portion thereof. The grooves 37, 38 aid in increasing the ease with which the fuel element is lighted. The burning and base portions of the fuel element do not have any longitudinally extending air passageways extending entirely therethrough.

Figure 3:
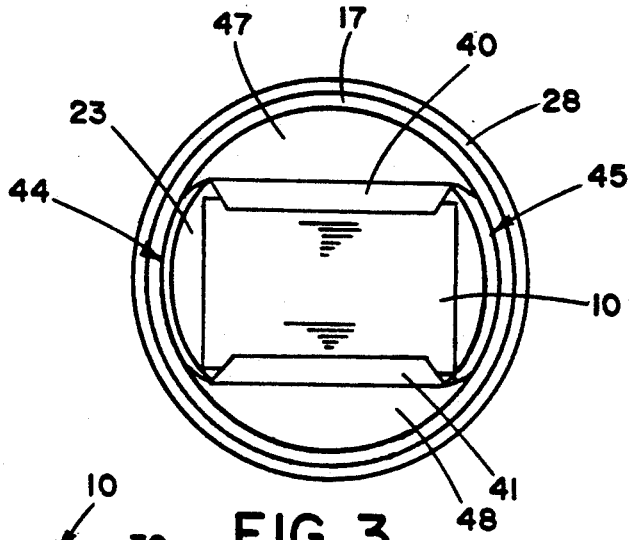
FIG. 3 is a cross sectional radial view of the cigarette shown in FIG. 1 taken along lines 3—3 in FIG. 1.

Referring to FIGS. 1, 2 and 3, the heat source or fuel element 10 is held in place within the enclosure member 17 by a retaining member 23 including grasping portions 40, 41 (shown in FIGS. 1 and 3) which contact the base segment 32 of the fuel element. Preferably, the enclosure member is a heat conductive cartridge. A highly preferred retaining member 23 has cross sectional dimensions such that it (i) fits securely within the cartridge 17, preferably by friction fit, and (ii) contacts the cartridge at regions 44, 45 (shown in FIGS. 2 and 3) along the inner surface of the cartridge. The retaining member also provides airflow passages 47, 48 (shown in FIGS. 1 and 3) for passage of drawn air through the cigarette. The retaining member is manufactured from a heat resistant material, such as a thin metal (e.g., aluminum) sheet.

Figure 4:
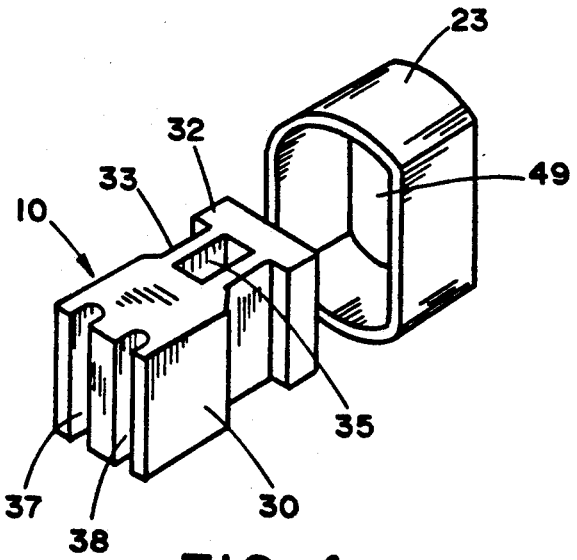
FIG. 4 is an exploded perspective of the unassembled fuel element and retaining member components of the cigarette shown in FIGS. 1 and 2.

Referring to FIG. 4, fuel element 10, which is shown as longitudinally separated from a cup shaped retaining member 23, is inserted into the retaining member, preferably so that the base portion 32 of the fuel element abuts inner bottom face 49 of the retaining member. As shown in FIG. 4, the preferred retaining member has a generally oval cross sectional shape (i.e., two rounded sides and two flattened sides). The shape and dimensions of the retaining member can be selected so as to provide for the desired airflow passage through the cigarette.

Figure 5:
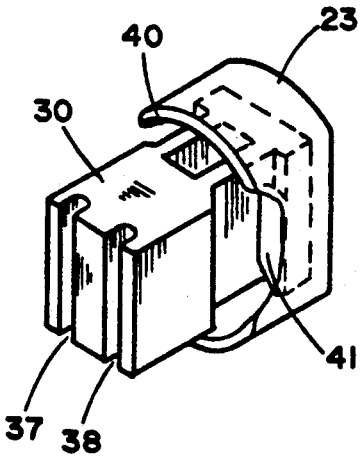
FIG. 5 is a perspective of the assembled fuel element and retaining member components of the cigarette shown in FIGS. 1 and 2.

Referring to FIG. 5, when the fuel element 10 (shown partially in phantom) is inserted into the cup shaped retaining member 23, two portions of the retaining member are crimped inwardly so as to form grasping portions 40, 41 which extend over adjacent portions of the base segment of the fuel element.

Referring again to FIGS. 1 and 2, the substrate 13 is positioned within the cartridge 17 which includes (i) an open end 50 at one end (i.e., towards the extreme lighting end 31) of the cigarette, and (ii) an opening 52 at the opposite end (i.e., toward the mouth end) of the cigarette. The substrate is enclosed and maintained within the cartridge physically separate from the fuel element. The retaining member 23 also can extend over that portion of the fuel element 10 (i.e., the back face of the fuel element) which faces the substrate 13 in order to (i) provide further physical separation of the fuel element from the substrate, and (ii) hold the substrate in place within the cartridge. The preferred retaining member provides a barrier to airflow and migration of aerosol forming material between the fuel element and the substrate. The substrate can have various forms. One or more types of substrate material can be incorporated into a portion of the cartridge 17. For example, the substrate can include gathered paper 54 which carries glycerin and a tobacco extract, is wrapped in a circumscribing paper wrapper 55, and is positioned adjacent the back face of the retaining member 23.

The cartridge 17 is manufactured from a heat resistant, thermally conductive material, such as a thin metal (e.g., aluminum) sheet. The cartridge is configured and positioned with respect to the fuel element 10 such that the cartridge (i) surrounds the longitudinal length of the fuel element, and (ii) is spaced apart from (e.g., not in direct contact with) the burning portion 30 of the fuel element. The burning portion of the fuel element can extend beyond the open end of the cartridge, be recessed from the open end of the cartridge, or extend so as to be flush with the open end of the cartridge (as shown in FIG. 1). The cartridge is open at the extreme lighting end of the cigarette so as to expose completely the extreme lighting end of the fuel element.

The cartridge 17 is radially spaced from the longitudinal outer periphery of the fuel element, and as such, does not in any way contact the longitudinal periphery of the fuel element. In such a manner, an airflow passage 57 is formed between the longitudinal outer periphery of the fuel element and the heat conductive cartridge. In addition, the configuration is such that heat generated by the burning segment 30 of the fuel element tends to radiate radially to heat the portion of the cartridge which encloses (i.e., surrounds) that segment of the fuel element. The radial spacing of the heat conductive cartridge from the burning portion of the fuel element preferably is such that an amount of heat sufficient to heat the substrate and aerosol forming material carried thereby radiates from the burning fuel element to the cartridge. Typically, the cartridge has a length of about 8 mm to about 20 mm, and a circumference of about 20 mm to about 28 mm.

The cartridge 17 is positioned at one end of a tubular mouthend piece 28. The mouthend piece preferably is manufactured from metal foil-lined paper, insulative ceramic material, molded plastic, heavy weight paper, or the like. The mouthend piece 28 preferably has a configuration and dimensions such that the cartridge fits snugly therein and can be held in place by a friction fit. A portion of the mouthend piece can circumscribe or otherwise surround a portion of the length of the cartridge, or the total length of the cartridge (as illustrated in FIGS. 1 and 2). Optionally, a series of perforations 58 or other types of air inlet openings, are provided through the mouthend piece and cartridge in the region thereof which surrounds the burning portion 30 of the fuel element 10. The size, number and positioning of the perforations can be selected so as to provide a controlled oxygen supply to the burning portion of the fuel element during the smoking period.

Within the tubular mouthend piece 28, behind the cartridge 17, is positioned a segment of gathered tobacco paper 60 wrapped in a circumscribing paper wrapper 61. Also within the mouthend piece, behind the gathered tobacco paper, is positioned a roll of tobacco cut filler 62 wrapped in a circumscribing paper wrapper 63. Also within the mouthend piece, and positioned at the extreme mouthend of the cigarette, is a low-efficiency filter element including a filter material 64 (e.g., a gathered web of non-woven polypropylene fibers) and a circumscribing plug wrap 65. The segment of gathered tobacco paper, the roll of tobacco cut filler and the filter element, can be held in place within the mouthend piece by a snug friction fit or using adhesive. If desired, a void space 66 (e.g., filling a length of the mouthend piece of about 10 mm or more) can be provided between the back end of cartridge 17 and the gathered tobacco paper 60. Normally, tipping paper 67 circumscribes the extreme mouthend region of the cigarette. Furthermore, a ring of air dilution perforations 68 optionally can be provided near the extreme mouthend region of the cigarette using laser or mechanical perforation techniques.

In use, the smoker lights the heat source or fuel element 10 (e.g., using a cigarette lighter) and the burning portion 30 of the fuel element burns to produce heat. The heat generated by the fuel element radiates outwardly to heat the portion of the cartridge 17 which encloses or surrounds the fuel element, and the heat is in turn conducted through the cartridge to the portion thereof which contacts the substrate 13 and aerosol forming material carried thereby. In addition, some heat is conducted through the base of the fuel element, and through the retaining member, to the substrate and aerosol forming material carried thereby. During draw by the smoker, drawn air passes through the airflow passage 57 between the fuel element and cartridge, and is heated upon contact with the hot fuel element and the heated cartridge. The heated drawn air then passes through the airflow passages 47, 48 between the retaining member 23 and the cartridge, and contacts the substrate 13 which is in a heat exchange relationship with the burning fuel element. The resulting heat applied to the aerosol forming material acts to volatilize that material. The volatilized material within the warm drawn air exits the cartridge through opening 52. The drawn air and volatilized material then cools during passage through the mouthend piece. Depending upon the particular aerosol forming material, a visible aerosol then is formed. In particular, the drawn air and volatilized material passes through the gathered tobacco paper 60, through the roll of tobacco cut filler 62, through the filter material 64, and into the mouth of the smoker. As the base portion does not burn during the use of the cigarette and the fuel element self-extinguishes after combustion of the burning portion is complete, the fuel element remains securely in the cigarette and does not have a tendency to become dislodged from the cigarette during use. Typically, the cigarette exhibits a tendency to self-extinguish when combustion of the burning portion of the fuel element is complete. When the fuel element self-extinguishes and no longer generates heat, the cigarette is disposed of.

Figure 6:
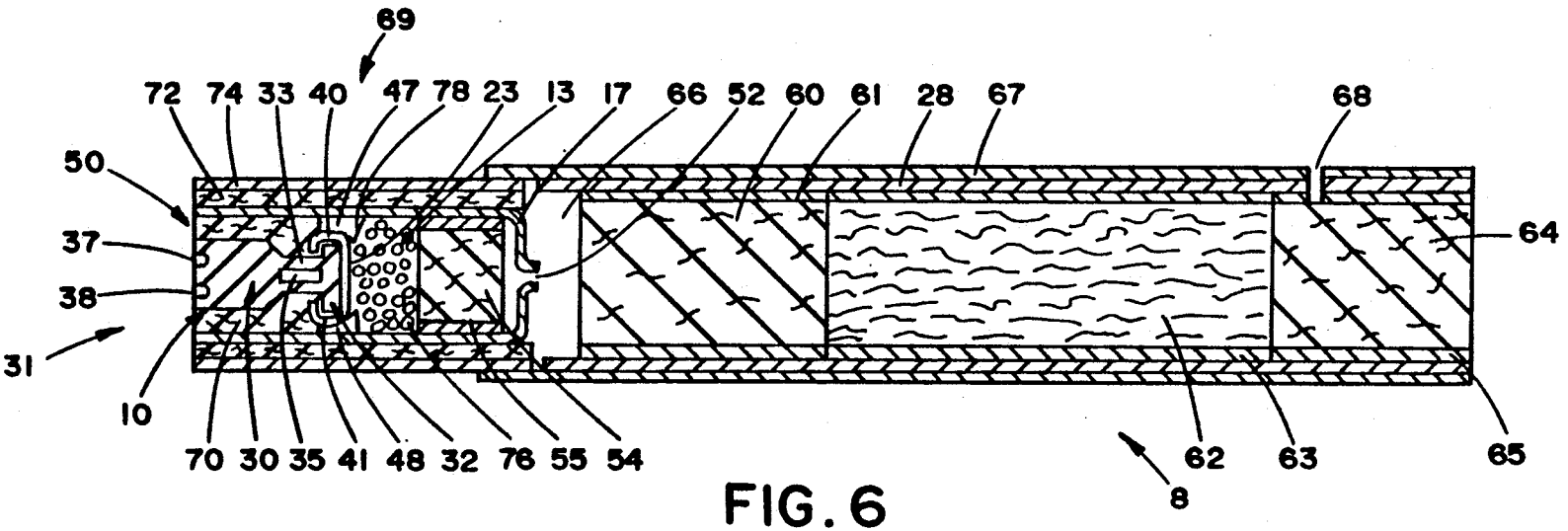
FIG. 6 is a longitudinal sectional view of a cigarette of the present invention.
Figure 7:
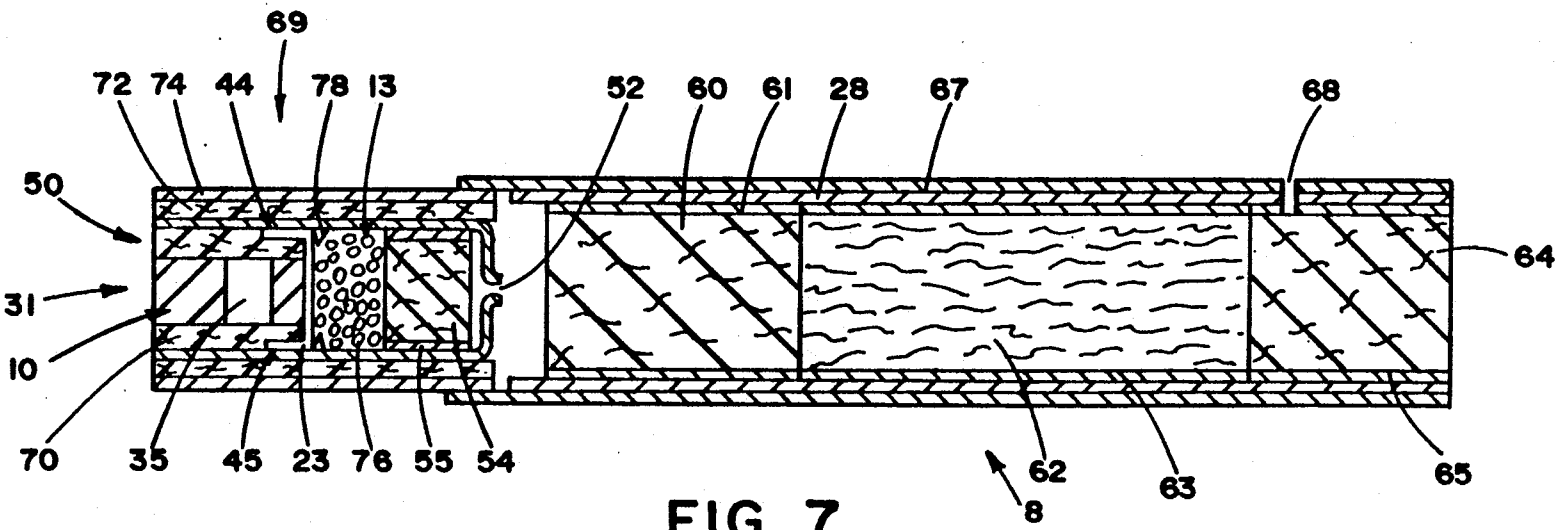
FIG. 7 is a longitudinal sectional view of the cigarette illustrated in FIG. 6, but rotated 90° about the longitudinal axis of the cigarette.

Referring to FIGS. 6 and 7, an alternate embodiment of the present invention has the form of a cigarette 8 which is similar in many respects to the cigarette illustrated in FIGS. 1, 2 and 3. The cigarette includes a front end assembly 69 including a fuel element 10; a substrate 13 which carries aerosol forming material; an enclosure member having the form of a heat conductive cartridge 17 which contains the substrate; and a retaining member which holds the fuel element in place within the cigarette. The cigarette also includes a separate tubular mouthend piece 28.

The fuel element 10, which preferably includes longitudinally positioned portions or segments, is circumscribed by an air permeable insulating material 70, such as glass fibers. Representative air permeable insulating materials are described in U.S. patent application Ser. Nos. 576,751, filed Aug. 29, 1990 and 601,551 filed Oct. 23, 1990; European patent Application No. 339,690; at pages 48–52 of *Chemical and Biological Studies of New Cigarette Prototypes That Heat Instead of Burn Tobacco,* R. J. Reynolds Tobacco Co. publication (1988); and in U.S. Pat. No. 4,756,318 to Clearman et al; all of which are incorporated herein by reference. The insulating material preferably (i) is such that drawn air can pass therethrough, (ii) is positioned and configured so as to assist in holding the fuel element in place, and (ii) has a character such that heat generated by the burning fuel element is transferred to the portion of the cartridge which is radially spaced from the fuel element.

The longitudinal outer periphery of the cartridge 17 is circumscribed by insulating material 72, such as insulating glass fibers. The insulating material 72 is such that heat generated by burning fuel element 10 and which is transferred to the cartridge 17, is used for efficiently heating the aerosol forming material of the aerosol generating means. The insulating material is circumscribed by an outer wrap 74, such as cigarette paper.

The cartridge 17 contains two types of substrate materials. In particular, the substrate includes (i) alumina beads 76, which carry glycerin and a tobacco extract, and which are positioned adjacent the back face of the retaining member 23, and (ii) gathered paper 54 which carries glycerin and a tobacco extract, which is wrapped in a circumscribing paper wrapper 55, and which is positioned behind the alumina beads. The cartridge can be crimped 78, or otherwise deformed to assist in securing the retaining member within the desired position within the cigarette.

Tubular mouthend piece 28 is positioned in an abutting end-to-end relationship with the front end assembly 69. Preferably, the cross-sectional shape and dimensions of the mouthend piece are essentially identical to those of the front end assembly. The front end assembly 69 and separate mouthend piece 28 are attached to one another using a circumscribing tipping material 67.

Figure 8:
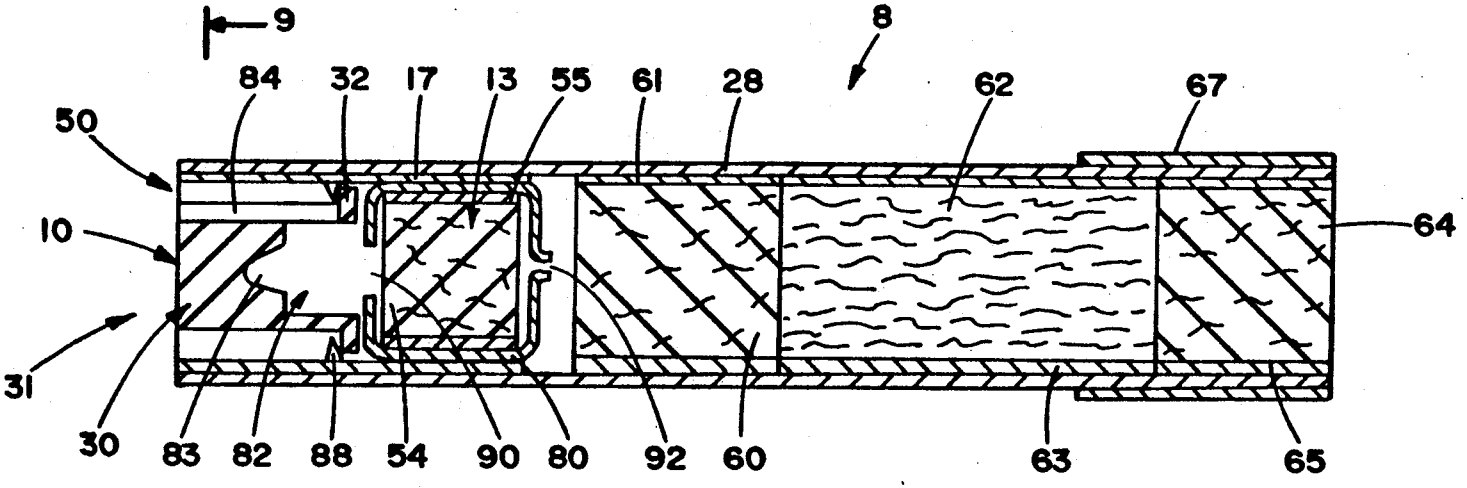
FIG. 8 is a longitudinal sectional view of a cigarette of the present invention.

Referring to FIG. 8, an alternate embodiment of the present invention has the form of a cigarette 8 which is similar in many respects to the cigarette illustrated in FIGS. 1 and 2. The cigarette includes a fuel element 10; a substrate 13 which carries aerosol forming material; a tubular heat conductive enclosure member 17 into which the fuel element is positioned; a heat conductive cartridge 80 positioned behind the fuel element and within the enclosure member, and containing the substrate; and a tubular mouthend piece 28.

The fuel element 10 has a generally circular radial cross sectional shape, and includes a base portion 32 and a burning portion 30. The circumference of the base portion 32 is greater than that of the burning portion 30. The preferred fuel element 10 is compression molded so as to have a hollow region 82 extending from the base portion towards the burning portion. Optionally, a series of air passageways (not shown) can extend longitudinally through the fuel element. Optionally, at least one hollow region 83 can extend into the burning portion of the fuel element, so that when the fuel element burns back during use, there can form at least one airflow passageway through the fuel element. The fuel element includes at least one groove or channel 84 extending longitudinally along the outer periphery of the burning portion toward the base portion such that the channel and the hollow region 82 connect. In such a manner, drawn air passes through channel 84, into hollow region 82, and then through the aerosol generating means.

Figure 9:
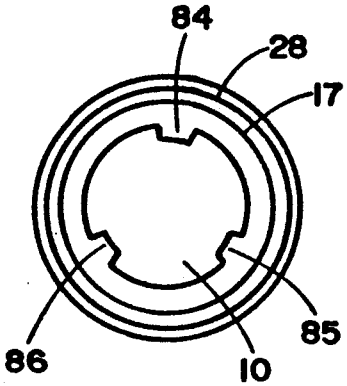
FIG. 9 is a cross sectional radial view of the cigarette shown in FIG. 8 taken along lines 9—9 in FIG. 8.

Referring to FIG. 9, the burning portion of fuel element 10 includes grooves 84, 85 and 86 extending along the outer longitudinal periphery thereof. Other configurations of grooves (e.g., 4 pairs of grooves spaced at 90° intervals) can be employed.

Referring again to FIG. 8, the fuel element 10 is inserted through the back of the enclosure member 17 such that the base portion 32 abuts inwardly extending lip or crimp 88. Then, the substrate 13 is positioned within cartridge 80, and the ends of that cartridge are crimped inwardly so as to enclose the substrate while maintaining inlet opening 90 and outlet opening 92 at each end of the cartridge. The cartridge then is inserted into the back of the enclosure member to abut the back of the base portion of the fuel element. Preferably, the inner dimensions of the enclosure member 17 and the outer dimensions of the cartridge 80 are such that the cartridge is secured firmly in place by a friction fit. As such, the front portion of the cartridge 80 and the crimp 88 in the enclosure member 17 provide a retaining means for holding the fuel element 10 securely in place within the cigarette.

FIGS. 10 through 16 illustrate representative configurations of heat sources or fuel elements which can be incorporated into smoking articles of the present invention, and particularly into those cigarettes previously described with reference to FIGS. 1 through 7.

Figure 10:
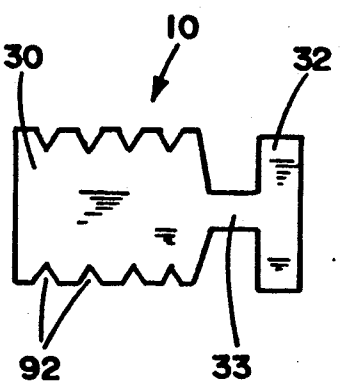

Referring to FIG. 10, fuel element 10 includes a burning portion 30, an isolation portion 33 and a base portion 32. The isolation portion has cross sectional outer dimensions which are significantly less than that of the base portion. In addition, the fuel element includes a plurality of notches 92 spaced longitudinally along the length of the burning portion, and extending transversely across the fuel element.

Figure 11:
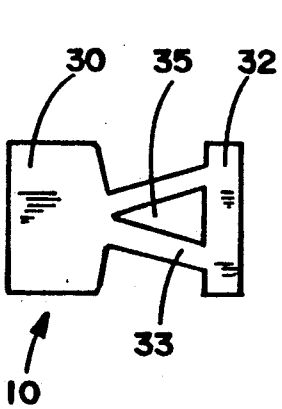

Referring to FIG. 11, fuel element 10 includes a void space 35 extending transversely through the fuel element. The void space has a generally triangular shape, having a base essentially parallel to the back face of the fuel element and a tip which extends the burning portion of the fuel element.

Figure 12:
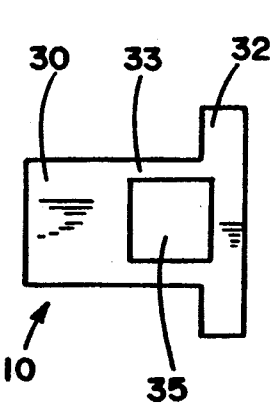

Referring to FIG. 12, fuel element 10 includes burning segment 30 and isolation segment 33 having identical cross sectional outer dimensions and base segment 32 having a cross sectional periphery which is greater than that of the burning and isolation segments. The fuel element includes a void space 35 extending transversely through the isolation segment and a portion of the length of the base segment.

Figure 13:
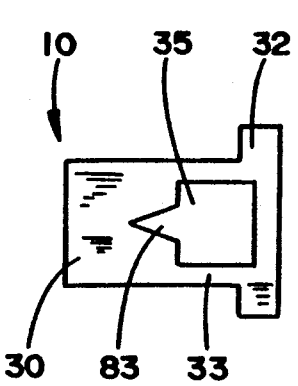

Referring to FIG. 13, fuel element 10 includes a void space 35 extending transversely through the isolation portion 33, and a further void space 83 extending transversely through a portion of the length of the burning portion. As such, when the burning portion of the fuel element burns back during use, a longitudinally extending passageway is formed through a portion of the fuel element. Thus, after a certain period during use within a smoking article, drawn air can pass through the burning fuel element (i.e., and hence be heated), and then pass to the aerosol generating means. The ability to have drawn air pass through the burning portion of the fuel element provides for increased heat transfer to the aerosol generating means for aerosol formation during later stages of use of the smoking article. As such, it is possible to provide a fuel element capable of providing a relatively consistent transfer of heat to the aerosol generating means over the useful life of the fuel element.

Figure 14:
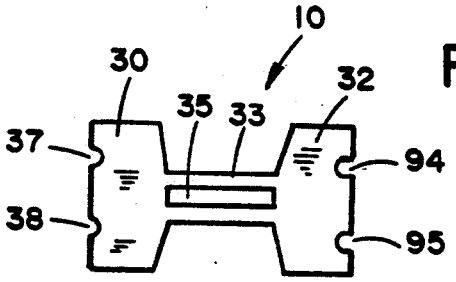
FIGS. 10 through 16 are longitudinal views of representative fuel elements for cigarettes of the present invention.

Referring to FIG. 14, fuel element 10 includes a burning segment 30, a base segment 32, and isolation segment 33 including a void space 35 extending transversely therethrough. The burning and base segments are similarly shaped, and as such, each end can be employed as a burning or base segment, depending upon the manner in which the fuel element is positioned within the smoking article. The fuel element also can include ribbed grooves 37, 38 extending across the foremost face of the burning segment, and ribbed grooves 94, 95 extending across the back face of the base segment.

Figure 15:
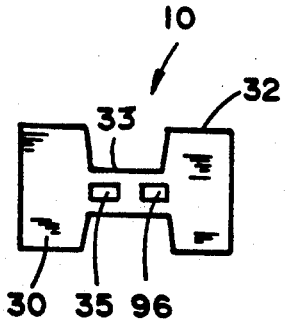

Referring to FIG. 15, fuel element 10 is similar to the fuel element described with reference to FIG. 14, except that two void spaces 35, 96 extend transversely through the isolation segment 33.

Figure 16:
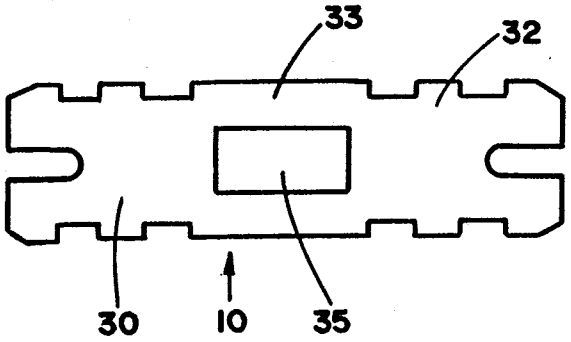

Referring to FIG. 16, fuel element 10 is similar to the fuel element described with reference to FIG. 14.

Figure 17:
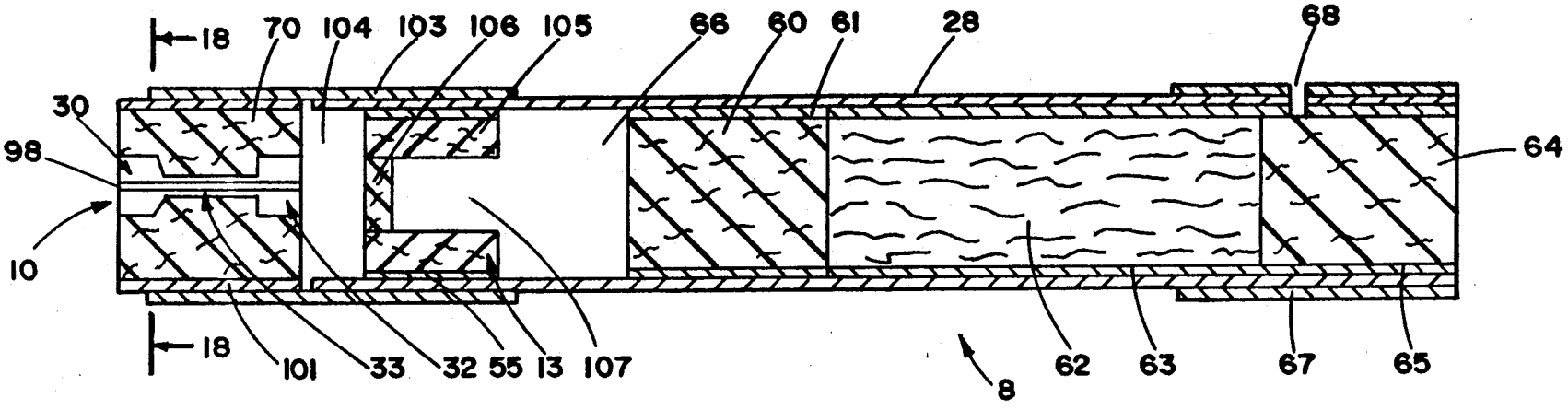
FIG. 17 is a longitudinal sectional view of a cigarette of the present invention.

Referring to FIG. 17, an alternate embodiment of the present invention has the form of a cigarette 8 which is similar in many respects to the cigarette illustrated in FIGS. 1, 2, 6 and 7. The cigarette includes a fuel element 10; a substrate 13 which carries aerosol forming material; a material 70 which surrounds the entire longitudinal periphery of the fuel element so as to hold the fuel element in place; and a tubular mouthend piece 28.

The fuel element 10 is longitudinally segmented, and includes a base portion 32, a burning portion 30 and an isolation portion 33 positioned between the burning and base portions. The fuel element 10 has a shape such that the circumference of the base portion 32 is greater than the circumference of the portion (e.g., the isolation portion 33) adjacent to the base portion. Preferably, the fuel element 10 includes at least one airflow passageway 98 extending as a slot or groove along the entire length of the fuel element.

The material 70 which surrounds the fuel element 10 can vary. The material 70 can be a material which has a tendency not to combust or a material which combusts easily to ensure ease of lighting of the smoking article. Most preferably, the material 70 is non-metallic in nature. Examples of suitable materials include glass fibers and other materials of the type in U.S. patent application Ser. No. 601,551, filed Oct. 23, 1990; European Patent Application No. 336,690; and pages 48–52 of *Chemical and Biological Studies of New Cigarette Prototypes That Heat Instead of Burn Tobacco*, R. J. Reynolds Tobacco Co. publication (1988). Examples of other suitable materials are glass fiber and tobacco mixtures such as are described in U.S. Pat. No. 4,756,318 to Clearman et al and U.S. patent application Ser. No. 576,751, filed Aug. 29, 1990. Examples of other suitable materials are gathered paper-type materials, shredded paper-type materials and paper-type materials which are spirally wrapped or otherwise wound around the fuel element. Suitable paper-type materials include treated papers; papers containing carbonaceous materials; tobacco-containing papers; wood pulp papers; sulfate papers; wood pulp/calcium carbonate containing papers; papers containing carbonaceous materials, wood pulp, tobacco and fillers such as those agglomerated materials described in U.S. patent application Ser. Nos. 414,833, filed Sep. 29, 1989 and 567,520, filed Aug. 15, 1990. The paper-type materials can be gathered or crimped and gathered around the fuel element; gathered into a rod using a rod making unit available as CU-10 or CU-20S from Decoufle s.a.r.b. or the apparatus described in U.S. Pat. No. 4,807,809 to Pryor et al.; wound around the fuel element about the longitudinal axis of the fuel element; or provided as longitudinally extending strands of paper-type sheet using the types of apparatus described in U.S. Pat. No. 4,889,143 to Pryor et al. and U.S. patent application Ser. No. 049,200, filed May 12, 1987, now U.S. Pat. No. 5,025,814 to Raker, which are incorporated herein by reference. Examples of paper-type sheet materials are available as P-2540-136-E carbon paper and P-2674-157 tobacco paper from Kimberly-Clark Corp.; and preferably the longitudinally extending strands of such materials (e.g., strands of about 1/32 inch width) extend along the longitude of the fuel element. The fuel element also can be circumscribed by tobacco cut filler (e.g., flue-cured tobacco cut filler treated with about 2 weight percent potassium carbonate). The number and positioning of the strands or the pattern of the gathered paper is sufficiently tight to maintain, retain or otherwise hold the fuel element within the cigarette.

The material 70 which surrounds the fuel element is circumscribed by a paper wrapper 101. Such a paper circumscribes the entire length of the material 70. An example of a suitable paper wrapper is available as P-850-63-5 from Kimberly-Clark Corp. A portion of the length of the paper wrapper 101 is in turn circumscribed by a second or outer paper wrapper 103. An example of a suitable outer paper wrapper is available as P-850-61-2 from Kimberly-Clark Corp.

The second paper wrapper 103 most preferably is a paper which exhibits a propensity not to burn (i.e., due to a very low porosity and/or due to chemical treatment), and preferably does not circumscribe paper wrapper 101 for a length of about 2 mm to about 8 mm, more preferably about 3 mm to about 6 mm, from the extreme lighting end of the cigarette. The second paper wrapper 103 also circumscribes at least a portion of the length of the tubular mouthend piece 28, and thereby act as a tipping material. The second wrapper acts to assist in preventing the fuel element from burning to any significant degree beyond the burning segment thereof. As such, the fuel element exhibits a tendency to self-extinguish prior to combustion, to any significant degree, of the isolation portion.

The substrate 13 is positioned behind the fuel element 10 within the tubular mouthend piece, and is positioned in a spaced apart relationship relative to the back end of the fuel element so as to have air space 104 therebetween. For example, the back end of the fuel element and the front end of the substrate are positioned about 1 mm to about 10 mm, preferably about 2 mm to about 5 mm apart. The substrate preferably includes a tube of gathered or layered paper 105, a short segment of gathered paper 106 positioned within the tube 105 at the end of the tube near the back end of the fuel element, and an air space 107 behind the gathered paper 106. The gathered paper provides a plurality of longitudinally extending airflow passageways. The gathered paper web normally is circumscribed by a paper wrapper 55. The inner surface of the tubular mouthend piece preferably is coated, particularly in the region thereof adjacent the substrate, with a material which tends to limit the amount of aerosol forming material which migrates from the substrate 13. Examples of suitable materials are ethyl cellulose (e.g., which is applied as a dilute solution in ethanol), or a material which is available as Hercon 70 from Hercules, Inc. The region of the mouthend piece adjacent the fuel element and/or the region of paper wrappers 101, 103 which are positioned outward from the base segment of the fuel element can be coated with aqueous solutions of calcium chloride or diammonium hydrogen orthophosphate, and allowed to dry.

Figure 18:
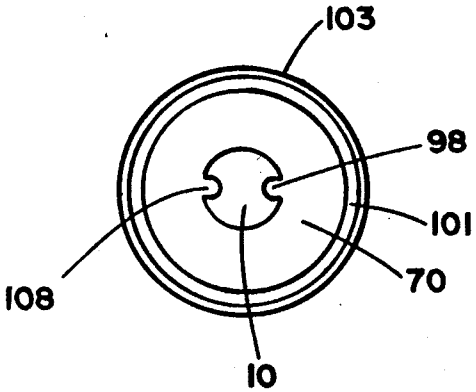
FIG. 18 is a cross sectional radial view of the cigarette shown in FIG. 17 taken along lines 18—18 in FIG. 17.

Referring to FIG. 18, the fuel element 10 includes grooves 98, 108 extending along the outer longitudinal periphery thereof. Other configurations of grooves or airflow passageways through the fuel element can be employed.

Figure 19:
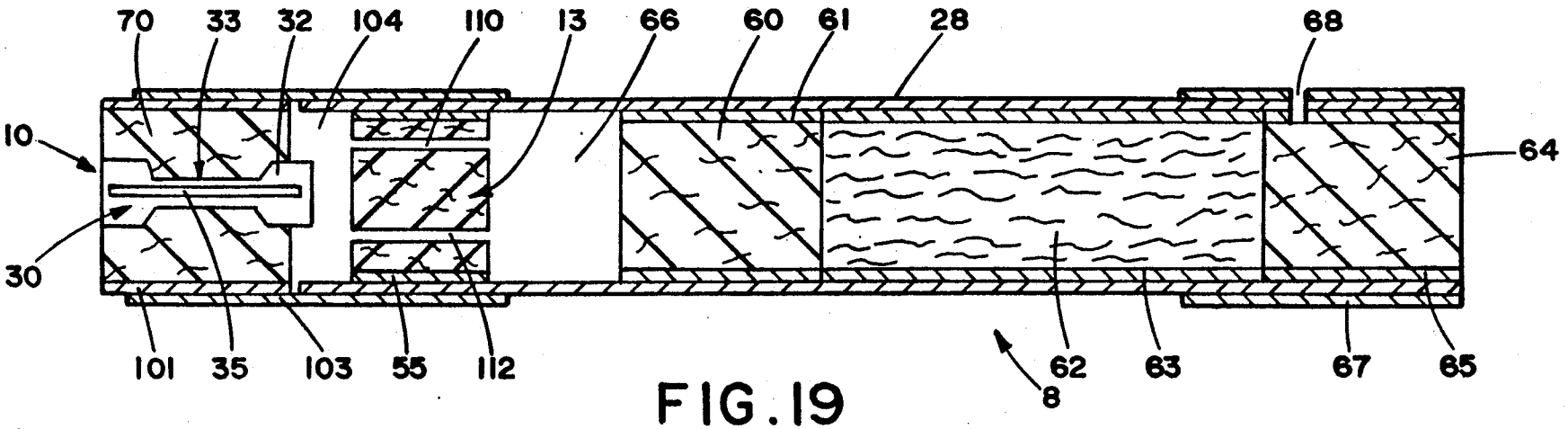
FIGS. 19 and 20 are longitudinal sectional views of cigarettes of the present invention.

Referring to FIG. 19, an alternate embodiment of the present invention has the form of cigarette 8 which is similar in many respects to the cigarette illustrated in FIG. 17. The cigarette includes a fuel element having a void space 35 extending entirely therethrough in a direction transverse to the longitudinal axis of the cigarette, and extending along a significant length of the fuel element. A portion of the length of the base portion 32 of the fuel element 10 extends beyond circumscribing material 70, and as such provides for an airflow passageway through the fuel element, particularly after the fuel element has been lit. Material 70 circumscribes the burning and isolation portions of the fuel element. However, if desired, a portion of the length of the burning portion can extend beyond the circumscribing material 70. The back end of the fuel element is positioned in a spaced apart relationship relative to the substrate 15. The substrate optionally can have certain fairly large longitudinally extending airflow passageways or grooves 110, 112.

Figure 20:
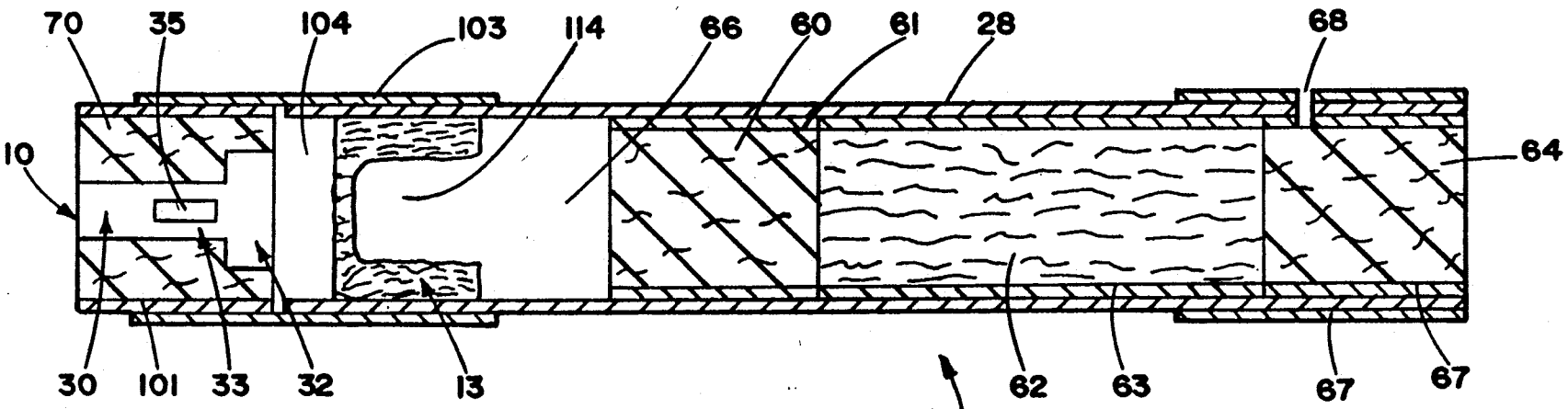

Referring to FIG. 20, an alternate embodiment of the present invention has the form of cigarette 8 which is similar in many respects to the cigarette illustrated in FIG. 17. The base portion 32 of the fuel element 10 has a significantly greater circumference than that of both of the burning and isolation portions 30, 33; and includes an airflow passageway (not shown) extending as a groove along the entire length of the fuel element. The substrate 13 is provided in an essentially cup shape within the tubular mouthend piece 28 by inserting a circular piece of paper having a diameter of about 2.5 to about 4 times that of the inner diameter of the mouthend piece through the extreme mouthend of the mouthend piece, and crimping or otherwise forming that paper to the desired shape within the mouthend piece.

Figure 21:
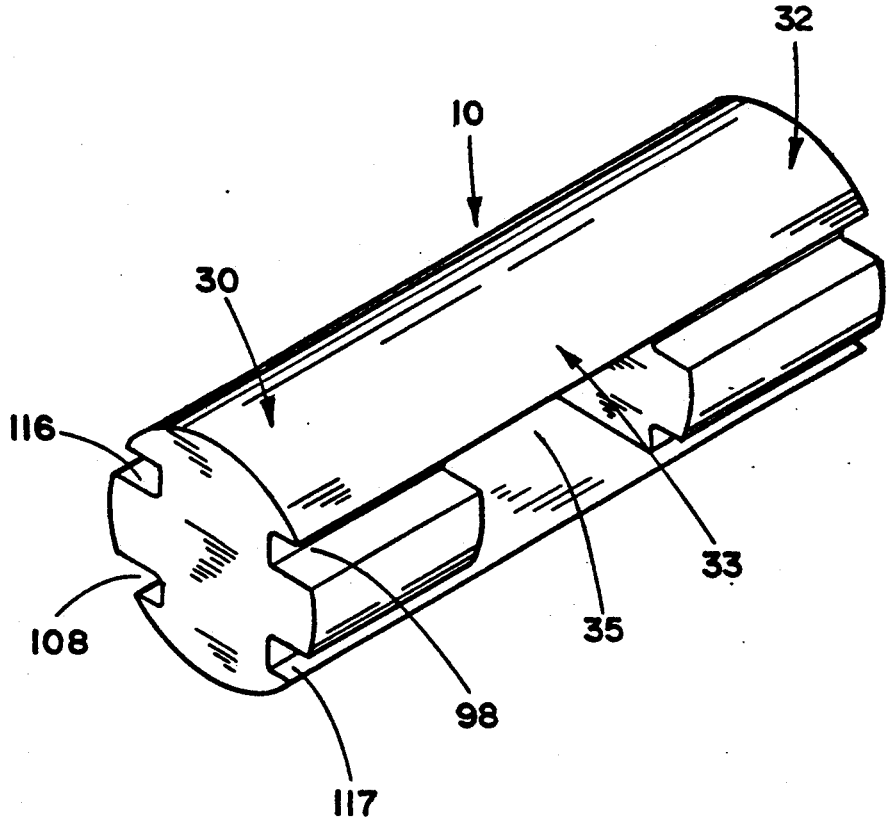
FIG. 21 is a perspective of a representative fuel element for cigarettes of the present invention.

Referring to FIG. 21 fuel element 10 includes void space 35 extending transversely through the isolation portion 33, and airflow passageways 98, 108, 116, 117 extending as grooves along the longitudinal periphery of the fuel element. Such a fuel element can be made by machining an extruded fuel element or by compression molding techniques. Such a fuel element is particularly suited for use in the types of cigarettes described with reference to FIGS. 17 and 19.

Smoking articles of the present invention incorporate some form of tobacco. The form of the tobacco can vary, and more than one form of tobacco can be incorporated into a particular smoking article. The tobacco can be incorporated in the fuel element, the aerosol generating means, and/or positioned within the mouthend piece in a manner so that various flavorful tobacco components are transferred to drawn aerosol passing through the mouthend piece. The type of tobacco can vary, and includes flue-cured, Burley, Md. and Oriental tobaccos, the rare and specialty tobaccos, as well as blends thereof.

One form of tobacco is tobacco cut filler (e.g., strands or shreds of tobacco filler having widths of about 1/15 inch to about 1/40 inch, and lengths of about ¼ inch to about 3 inches). Tobacco cut filler can be provided in the form of tobacco laminae, volume expanded or puffed tobacco laminae, processed tobacco stems including cut-rolled or cut-puffed stems, or reconstituted tobacco material. Processed tobaccos, such as those described in U.S. patent application Ser. Nos. 392,519, filed Aug. 10, 1989, now U.S. Pat. No. 5,025,812, to Fagg et al., and 484,587, filed Feb. 23, 1990, also can be employed. Reconstituted tobacco material can be provided using cast sheet techniques; papermaking techniques, such as described in U.S. Pat. Nos. 4,962,774 to Thomasson et al and 4,987,906 to Young et al; or extrusion techniques, such as are described in U.S. Pat. No. 4,821,749 to Toft et al. Cut filler normally is incorporated into the cigarette as a cylindrical roll or charge of tobacco material which is wrapped in a circumscribing paper wrapper. Tobacco cut filler can be provided as a roll in a paper wrapper using cigarette rod making techniques and apparatus which are well known by the skilled artisan. Tobacco cut filler also can be incorporated in the aerosol generating means, if desired. Another form of tobacco is tobacco paper. For example, a web of tobacco paper available as P144-GNA from Kimberly-Clark Corp. can be gathered into a cylindrical segment in a manner set forth in Example 2 of U.S. Pat. No. 4,807,809 to Pryor et al. Cylindrical segments of gathered tobacco paper can be incorporated (i) into the aerosol generating means to act as a substrate for the aerosol forming material, and/or (ii) within the mouthend piece of the cigarette. If desired, tobacco paper can form an inner liner of the tubular mouthend piece of the smoking article.

Another form of tobacco is finely divided tobacco material. Such a form of tobacco includes tobacco dust and finely divided tobacco laminae. Typically, finely divided tobacco material is carried by the substrate which is positioned within the aerosol generating means. However, finely divided tobacco material also can be incorporated into the fuel element.

Another form of tobacco is a tobacco extract. Tobacco extracts typically are provided by extracting a tobacco material using a solvent such as water, carbon dioxide, sulfur hexafluoride, a hydrocarbon such as hexane or ethanol, a halocarbon such as a commercially available Freon, as well as other organic and inorganic solvents. Tobacco extracts can include spray dried tobacco extracts, freeze dried tobacco extracts, tobacco aroma oils and tobacco essences. Methods for providing suitable tobacco extracts are set forth in U.S. Pat. Nos. 4,506,682 to Mueller and 4,986,286 to Roberts et al; European Patent Application Nos. 326,370 and 338,831; and U.S. patent application Ser. No. 452,175 filed Dec. 18, 1989. Also useful are flavorful tobacco compositions such as those described in European Patent Application No. 374,779. Yet another tobacco extract is provided by extracting 1 weight part tobacco cut filler with about 6 weight parts water in a stainless steel column at ambient temperature to provide an aqueous tobacco extract having a solids content of about 15 weight percent; freezing the aqueous extract to a frozen block; melting about one half of the weight of the frozen block; collecting the resulting melted water and extract; freezing the extract and water so collected to a frozen block; melting about one half of the weight of the frozen block; and collecting the resulting melted water and extract. Typically, at least one tobacco extract is carried by the substrate of the aerosol generating means; although the tobacco cut filler, tobacco paper and filter material are positioned elsewhere within the cigarette. Furthermore, tobacco extract can be incorporated into the fuel element.

A smoking article of the present invention includes an aerosol generating means which is physically separate from the fuel element. As such, the aerosol generating means is not mixed with, or is not part of, the fuel element. The aerosol generating means is in a heat exchange relationship with the fuel element in order that heat generated by the burning fuel element is transferred to the aerosol generating means for heating and volatilizing the aerosol forming material, particularly during periods of draw by the smoker.

The preferred aerosol generating means includes a substrate for carrying the aerosol forming material. Preferred substrates retain the aerosol forming material when not in use, and release the aerosol forming material during the smoking period.

One type of substrate has the form of a non-woven sheet-like material or a cellulosic material, such as paper, carbon paper or tobacco paper. Such a substrate typically is provided as a cylindrical segment including a shredded, gathered, pleated or crimped web of paper-type material within a circumscribing outer wrapper. The circumscribing outer wrapper preferably is a paper material, and can be a paper material treated so as to limit the migration of aerosol forming material to other parts of the smoking article. If desired, the circumscribing outer wrapper can be a metallic (e.g., aluminum) foil. Such cylindrical segments can be provided from rods which are manufactured using equipment and techniques described in U.S. Pat. No. 4,807,809 to Pryor et al. Exemplary papers which are gathered to form substrates are available as MS2408/S538 from Filtrona, Ltd. as well as P-1976-29-5, P-1976-29-7, P-1976-29-1, P-1976-29-8 and P-1976-29-11 from Kimberly-Clark Corp. Combinations of two or more papers or paper-type materials can be employed. Exemplary tobacco papers which are gathered to form substrates are available as P144-GNA from Kimberly-Clark Corp., and also include the carbon filled tobacco sheet materials described in European Patent Application No. 342,538, which is incorporated herein by reference. Another substrate can have the form or a porous, air permeable pad which wicks liquid aerosol forming material from a container. The sheet-like material used as the substrate can have fillers having certain pore structures physically mixed therewith and/or incorporated therein in order to control migration of aerosol forming material from the substrate. However, substrates manufactured from non-metallic materials, and absent of metallic materials are often preferred.

Another type of substrate material is a thermally stable material (e.g., a material capable of withstanding temperatures of about 400° C. to about 600° C. without decomposing or burning). Examples of such materials include porous grade carbons, graphite, carbon yarns, activated and non-activated carbons, and ceramics. Suitable carbon substrate materials include PC-25 and PG-60 available from Union Carbide Corp., SGL available from Calgon Carbon Corp., and Catalog Nos. CFY-0204-1, CN-157(HC), CN-210(HC), ACN-211-10 and ACN-157-10 from American Kynol Inc. Other suitable substrate materials include alpha alumina beads available as D-2 Sintered Alpha Alumina from W. R. Grace & Co., as well as those substrate materials described in U.S. Pat. No. 4,827,950 to Banerjee et al. If desired, the substrate material can be a porous, air permeable extruded material.

Another type of substrate has the form of a densified pellet formed from carbon, tobacco, mixtures of carbon and tobacco, mixtures of alumina and tobacco, or mixtures of paper and tobacco. Densified pellets can be manufactured using a Marumerizer available from Fuji Paudal KK, Japan. See, German Patent No. 1,294,351, U.S. Pat. No. Re 27,214 and Japanese Patent Specification No. 8684/1967.

More than one type of substrate material can be employed in providing the aerosol generating means. For example, alumina beads which carry aerosol forming material can be positioned behind the fuel element, and a cylindrical segment of gathered paper carrying aerosol forming material can be positioned behind the alumina beads.

The aerosol generating means includes aerosol forming material, and the aerosol forming material is in a heat exchange relationship with the fuel element. The aerosol forming material can have a liquid, semi-solid or solid form, and generally is carried by a substrate. Examples of preferred aerosol forming materials include the polyhydric alcohols (e.g., glycerin, propylene glycol, triethylene glycol and tetraethylene glycol), the aliphatic esters of mono-, di-, or poly-carboxylic acids (e.g., methyl stearate, dimethyl dodecandioate and dimethyl tetra decanedioate), Hystar TPF available from Lonza, Inc., and the like, as well as mixtures thereof. For example, glycerin, triethylene glycol and Hystar TPF can be mixed together to form an aerosol forming material. Examples of other aerosol forming materials include volatile flavoring agents and tobacco flavor modifiers. Volatile flavoring agents include menthol, vanillin, cocoa, licorice, organic acids, high fructose corn syrup, and the like. Various other flavoring agents for smoking articles are set forth in Leffingwell et al, *Tobacco Flavoring For Smoking Products* (1972) and in European Patent Application No. 407,792. Tobacco flavor modifiers include levulinic acid, metal (e.g., sodium, potassium, calcium and magnesium) salts of levulinic acid, and the like.

The amount of aerosol forming material which is employed per smoking article can vary and depends upon factors such as the components of the aerosol forming material and the composition of the particular substrate which carries the aerosol forming material. Generally, the amount of aerosol forming material employed per smoking article ranges from about 20 mg to about 200 mg, preferably about 35 mg to about 150 mg. When paper or paper-type substrates are employed, it is preferable that the weight of the aerosol forming material which is carried by that substrate be about 2 to about 4 times the dry weight of the substrate material.

The smoking article of the present invention includes a heat source which generates heat sufficient to volatilize aerosol forming material within the aerosol generating means. A preferred heat source or fuel element is manufactured from a combustible material in such a way that the density of the fuel element is greater than about 0.5 g/cc, frequently about 0.7 g/cc or more, often about 1 g/cc or more, sometimes about 1.5 g/cc or more, but typically less than about 2 g/cc. Additionally, the fuel element generally has a length, prior to burning, of less than about 20 mm, often less than about 15 mm, and frequently less than about 10 mm.

A highly preferred fuel element has a segmented design. Such a fuel element is designed in order that during use of the smoking article into which the fuel element is incorporated (i) a portion of the length of the fuel element is available for burning, and (ii) a remaining longitudinal portion of the fuel element does not burn. The portion of the fuel element which is designed not to burn can be provided with such a characteristic as a result of factors such as (i) the selection of the composition of that portion of the fuel element, (ii) the overall shape or configuration of the fuel element, (iii) the location of the fuel element within the smoking article, and (iv) the manner in which the fuel element is secured within the smoking article. The preferred segmented fuel element includes (i) a burning portion for heat generation, (ii) a non-burning portion including a base or support portion, and (iii) an isolation portion positioned between the burning and base portions. A preferred segmented fuel element also is designed and configured so that heat does not transfer readily from the burning portion of the fuel element to the non-burning portion of the fuel element. As such, conductive transfer of heat from the fuel element to other regions of the smoking article is controlled, and preferably is minimized, in order that the burning fuel element does not exhibit a propensity to self-extinguish over normal smolder periods. Normally, the length of the burning portion of the fuel element is about 2 mm to about 15 mm, preferably about 4 mm to about 8 mm, prior to burning. Normally, the length of the base portion of the fuel element is about 1 mm to about 3 mm. Normally, the length of the isolation portion of the fuel element is up to about 10 mm, preferably up to about 5 mm.

A preferred fuel element has a radial or transverse cross section such that two opposite sides thereof are essentially parallel to one another. Also, preferred segmented fuel elements are such that the transverse cross sectional shape of each segment, and particularly the base segment, is generally square, rectangular or parallelepiped (i.e., each segment of the fuel element has four sides extending along the length of the fuel element, and each pair of opposite sides are essentially parallel to one another).

The maximum cross sectional dimensions of the fuel element can vary, but are such that the burning portion of the fuel element does not contact the enclosure member which surrounds that portion of the fuel element. Typically, the burning portion of the fuel element is positioned about 0.2 mm to about 2 mm, but preferably at least about 1 mm, from the enclosure member. A typical burning portion of a fuel element has a cross sectional area of about 10 $mm^2$ to about 25 $mm^2$. A typical base portion of a fuel element has a cross sectional area of about 15 $mm^2$ to about 30 $mm^2$. Although it is desirable that the cross sectional dimensions of the isolation portion of the fuel element be as small as possible, a typical isolation portion has a cross sectional area of about 5 $mm^2$ to about 10 $mm^2$.

The composition of the combustible material of the fuel element can vary. Preferred fuel elements contain carbon, and highly preferred fuel elements are composed of carbonaceous materials. Preferred carbonaceous materials have a carbon content above about 60 weight percent, more preferably above about 75 weight percent. Flavors, tobacco extracts, fillers (e.g. clays or calcium carbonate), burn additives (e.g., sodium chloride to improve smoldering and act as a glow retardant), combustion modifying agents (e.g., potassium carbonate to control flammability), binders, and the like, can be incorporated into the fuel element. Exemplary compositions of preferred carbonaceous fuel elements are set forth in U.S. Pat. Nos. 4,714,082 to Banerjee et al, 4,756,318 to Clearman et al and 4,881,556 to Clearman et al; as well as in European Patent Application Nos. 236,992 and 407,792; which are incorporated herein by reference. Other fuel elements can be provided from comminuted tobacco material, reconstituted tobacco material, heat treated or pyrolyzed tobacco materials, cellulosic materials, modified cellulosic materials, and the like. Exemplary materials are set forth in U.S. Pat. Nos. 4,347,855 to Lanzilotti et al; 3,931,824 to Miano et al; 3,885,574 to Borthwick et al and 4,008,723 to Borthwick et al; as well as in Sittig, *Tobacco Substitutes,* Noyes Data Corp. (1976). Exemplary carbonaceous materials are coconut hull carbons, such as the PXC carbons available as PCB and the experimental carbons available as Lot B-11030-CAC-5, Lot B-11250-CAC-115 and Lot 089-A12-CAC-45 from Calgon Carbon Corp.

Fuel elements for smoking articles of the present invention advantageously are molded, machined, pressure formed or extruded into the desired shape. Molded fuel elements can have passageways, slots, grooves or hollow regions therein. Preferred extruded carbonaceous fuel elements can be prepared by admixing up to 95 parts carbonaceous material, up to 20 parts binding agent and up to 20 parts tobacco (e.g., tobacco dust and/or a tobacco extract) with sufficient water to provide a paste having a stiff dough-like consistency. The paste then can be extruded using a ram, screw or piston type extruder into an extrudate of the desired shape having the desired number of passageways or void spaces. The extrudate can be passed through a pair of spiked or grooved rollers in order to imprint grooves (either transversely or longitudinally to the extrusion axis of the extrudate) at regular intervals, so as to provide a particular surface character to selected surfaces of the ultimate fuel element. The extrudate then can be dried to a low moisture content, typically between about 2 and about 7 weight percent. Then, a continuous length of extrudate is cut or otherwise subdivided at regular intervals, to provide a plurality of individual fuel elements. As such, it is possible to provide a fuel element having an extrusion axis which is perpendicular (i.e., rather than parallel) to the longitudinal axis of the smoking article into which the fuel element is ultimately incorporated. If desired, various types of materials can be co-extruded to provide fuel elements having burning portions and base portions which are of different compositions. For example, (i) the base and isolation portions of the fuel element can be composed of a material having a combustion propensity less than that material which is used to provide the burning portion of the fuel element, or (ii) the extreme lighting end of the fuel element can be composed of a material having an extremely high combustion propensity so as to increase the ease with which the fuel element is lighted.

The enclosure member is manufactured from a heat resistant material. The enclosure member preferably is a heat conducting member, and normally is composed of a metallic sheet strip or foil. Typically, the thickness of the conducting member ranges from about 0.01 mm to about 0.2 mm. The thickness, shape and/or type of material used to manufacture the heat conducting member can vary, in order to provide the desired degree of heat transfer to the aerosol forming material. A preferred heat conducting member is manufactured from thin aluminum sheet. The heat conducting member (i) can have a one piece construction or be manufactured from two or more segments, or (ii) be manufactured from one or more heat conductive materials.

The heat conducting member preferably extends over at least a portion of the length of the burning portion of the fuel element, and forms a container which encloses the aerosol forming material. The heat conducting member is radially spaced from a significant portion of the length of the burning portion of the fuel element, and can extend beyond the foremost lighting end of the fuel element. In the most highly preferred embodiments, the heat conducting member is spaced apart from the burning portion of the fuel element as well as the isolation and base portions of the fuel element (i.e., the fuel element is physically isolated from the heat conducting member). As such, conductive heat transfer from the fuel element to the heat conductive member (and hence to the aerosol generating means) is controlled and preferably is minimized.

Preferably, the fuel element is positioned within the smoking article so that the burning portion of the fuel element is thermally isolated from heat sinking components of the smoking article. Furthermore, the fuel element is positioned within the smoking article so that the fuel element experiences a limited or regulated oxygen supply during the burning period. As such, it is highly preferable to employ small, low mass fuel elements which heat up quickly, burn sufficiently to maintain an operating temperature (and hence not self-extinguish), and produce heat sufficient for aerosol formation during the period when the smoking article is drawn upon. The radial spacing between the burning portion of the fuel element and the heat conducting member is close enough so that heat generated by the burning fuel element transfers radiantly to the heat conducting member. However, the radial spacing between the burning portion of the fuel element and the heat conducting member is such that the burning portion receives a sufficient supply of oxygen for the fuel element to sustain smolder during the period of normal use of the smoking article. In addition, the fuel element and heat conducting member preferably are arranged such that drawn air passing through an airflow passage between the fuel element and the heat conducting member is heated thereby providing convective heating of the aerosol generating means. The spacing or configuration of the fuel element and heat conducting member can be selected in order to provide for the desired amount of convective heat transfer. Alternatively, the drawn air can pass through an airflow passage formed within the heat conducting member, such that the drawn air is heated as it passes through that passage to the aerosol generating means. If desired, the heat conducting member can be configured so that drawn air experiences a tortuous path prior to and/or during contact with the aerosol forming material.

The retaining means can vary in shape and composition. However, the retaining means most preferably is manufactured from a thin metal sheet which can be easily deformed so as to (i) hold the fuel element securely in place, and (ii) remain in position within the smoking article. In the preferred embodiments, a retaining member acts as a physical barrier between the fuel element and the aerosol forming material within the aerosol generating means. In the most highly preferred embodiments, the retaining means provides an air impermeable barrier between the back face of the fuel element and the aerosol generating means. As such, migration of aerosol forming material to the fuel element is minimized. In the preferred embodiments, a controlled spacing between one or more regions between the retaining member and the heat conducting member permits drawn air to be drawn across the fuel and into the aerosol generating means (i.e., at least one air passageway is provided). If desired, passageways or slits can be formed in the back face of the retaining member for airflow passage, or the retaining member can be deformed or slit to provide for a secure holding of the fuel element as well as for adequate airflow passage.

Although much less preferred, the retaining means can be manufactured from a series of wires or wire mesh. The wire can be formed to grasp the base of the fuel element as well as hold the fuel element in place within the smoking article. The selection of the particular wire, as well as the selected configuration of the wire so that the fuel element is held securely in place within the smoking article, will be apparent to the skilled artisan. One end of the wire can be molded into the fuel element, and the opposite end of the wire can be used to secure the fuel element in place within the article. If desired, a series of wires can extend through and/or around the fuel element to secure the fuel element in place. Alternatively, a series of wires can pass through a combustion-resistant portion of a co-extruded fuel element in order to hold the fuel element securely in place. Such co-extruded fuel elements include a combustible portion for heat generation and a combustion-resistant portion, extending either transversely across or longitudinally through the fuel element, through which the wire retaining means extends. As such, it is possible to maintain the fuel element within the smoking article, both prior to use and while the fuel element is burned during use. Typically, fuel elements are extruded with passageways extending therethrough in order that the wires which make up the retaining member conveniently can be passed through the fuel element in order to hold the fuel element in place. Retaining members manufactured from thin metal wires or wire mesh provide for good thermal isolation of the fuel element because thin wires tend not to conduct large amounts of heat very effectively to other components of the smoking article. A smoking article having a wire or wire mesh retaining member optionally can be provided with a perforated end cap which extends over the foremost lighting end of the smoking article.

In most embodiments of the present invention, the heat conductive cartridge which contains the substrate and the aerosol forming material is attached to the mouthend piece; although a disposable fuel element and cartridge can be employed with a separate mouthend piece, such as a reusable cigarette holder. The mouthend piece provides a passageway which channels vaporized aerosol forming materials into the mouth of the smoker; and can also provide further flavor to the vaporized aerosol forming materials. Typically, the length of the mouthend piece ranges from 40 mm to about 85 mm. Typically, the length of the mouthend piece is such that (i) the burning portion of the fuel element and the hot heat conducting member are kept away from the mouth and fingers of the smoker; and (ii) hot vaporized aerosol forming materials have sufficient time to cool before reaching the mouth of the smoker. Oftentimes, it is highly desirable to provide a void space within the mouthend piece immediately behind the aerosol generating means. For example, a void space extending at least about 10 mm along the length of the smoking article is provided immediately behind the aerosol generating means and forward of any tobacco cut filler, tobacco paper or filter segments.

Suitable mouthend pieces normally are inert with respect to the aerosol forming material, offer minimum aerosol loss as a result of condensation or filtration, and are capable of withstanding the temperatures experienced during use of the smoking article. Exemplary mouthend pieces include plasticized cellulose acetate tubes, such as is available as SCS-1 from American Filtrona Corp.; polyimide tubes available as Kapton from E. I. duPont de Nemours; paperboard or heavy paper tubes; and aluminum foil-lined paper tubes.

The entire length of the smoking article, or any portion thereof, can be overwrapped with cigarette paper. Preferred papers which circumscribe the heat conducting member should not openly flame during use of the smoking article, should have controllable smolder properties, and should produce a gray ash. Exemplary, cigarette papers are described in U.S. Pat. No. 4,779,631 to Durocher et al and European Patent Application No. 304,766. Suitable paper wrappers are available as P1981-152, P1981-124 and P1224-63 from Kimberly-Clark Corp. Tipping paper can circumscribe the extreme mouth end of the smoking article. Suitable tipping papers are non-porous tipping papers treated with "non-lipsticking" materials, and such papers will be apparent to the skilled artisan.

A segment of gathered tobacco paper can be incorporated into the mouthend piece. Such a segment can be positioned directly behind the heat conducting member which contains the aerosol forming material. A segment of gathered carbon paper can be incorporated into the mouthend piece, particularly in order to introduce menthol flavor to the aerosol. Suitable gathered carbon paper segments are described in European Patent Application No. 342,538. If desired, a segment including a gathered web of non-woven polypropylene or polyester in intimate contact with a water soluble tobacco extract can be incorporated into the mouthend piece. Such a segment is described in U.S. patent application Ser. Nos. 414,835, filed Sep. 29, 1989 and 621,499, filed Dec. 7, 1990.

The extreme mouthend of the smoking article preferably includes a filter element or tip, particularly for aesthetic reasons. Preferred filter elements are low efficiency filter elements which do not interfere appreciably with aerosol yields. Suitable filter materials include low efficiency cellulose acetate or polypropylene tow, baffled or hollow molded polypropylene materials, or gathered webs or nonwoven polypropylene materials. Suitable filter elements can be provided by gathering a non-woven polypropylene web available as PP-100-F from Kimberly-Clark Corp. using the filter rod forming apparatus described in Example 1 of U.S. Pat. No. 4,807,809 to Pryor et al.

Smoking articles of the present invention are capable of providing at least about 6 to about 10 puffs, when smoked under FTC smoking conditions. FTC smoking conditions consist of a 35 ml puff volume of 2 seconds duration, separated by 58 seconds of smolder. A typical fuel element of a preferred smoking article of the present invention provides less than about 300 calories, preferably between about 200 and about 250 calories, when the article is smoked under FTC smoking conditions. During the period that the preferred smoking article is smoked, at least about 40 percent, preferably at least about 65 percent, more preferably at least about 75 percent of the heat produced by the burning fuel element is used for heating the aerosol generating means and for the consequential generation of aerosol for mainstream aerosol delivery.

Preferred combustible fuel elements generate temperatures of about 400° C. to about 850°C., more preferably about 400° C. to about 700° C. Due to the relatively low temperatures and relatively low amounts of heat generated by the preferred fuel elements, typical smoking articles incorporating such fuel elements yield less than about 10 mg, preferably less than about 5 mg, and most preferably less than about 2 mg of carbon monoxide, when smoked under FTC smoking conditions.

Preferred smoking articles of the present invention are capable of yielding at least about 0.6 mg of aerosol, measured as wet total particulate matter (WTPM), in the first 3 puffs, when smoked under FTC smoking conditions. Moreover, preferred smoking articles yield an average of at least about 0.2 mg of WTPM per puff, for at least about 6 puffs, preferably at least about 10 puffs, when smoked under FTC smoking conditions. Highly preferred smoking articles yield at least about 5 mg of WTPM over at least 10 puffs, when smoked under FTC smoking conditions.

The aerosol produced by the preferred smoking articles of the present invention is chemically simple, consisting essentially of air, water, oxides of carbon, the aerosol former, any desired flavors or other desired volatile materials, and trace amounts of other materials.

The WTPM produced by certain preferred smoking articles of the present invention has little or no measurable mutagenic activity as measured by the Ames test, (i.e., there is little or no significant dose response relationship between the WTPM produced by preferred cigarettes of the present invention and the number of revertants occurring in standard test microorganisms exposed to such products). According to the proponents of the Ames test, a significant dose dependent response indicates the presence of mutagenic materials in the products tested. See Ames et al., *Mut. Res.*, 31: 347-364 (1975); Nagao et al., *Mut. Res.*, 42: 335 (1977).

The following examples are provided in order to further illustrate various embodiments of the invention, but should not be construed as limiting the scope thereof. Unless otherwise noted, all parts and percentages are by weight.

EXAMPLE 1

Cigarettes of the type illustrated in FIG. 1 are manufactured in the following manner:

Fuel Element Preparation

A segmented fuel element has base, isolation and burning portions; and an overall length of about 7 mm. The longitudinal length of the base portion is about 2 mm, the longitudinal length of the isolation portion is about 2 mm, and the longitudinal length of the burning portion is about 3 mm. The cross sectional shape of the base portion is rectangular, and the base portion is about 4 mm wide and about 5.4 mm high. The cross sectional shape of the isolation portion is square, and the isolation portion is about 4 mm wide and about 4 mm high. The cross sectional shape of the burning portion is square, and the burning portion is about 4 mm high and about 4 mm wide. The fuel element includes a void space having a rectangular shape, extending about 2.5 mm longitudinally and 2.2 mm across. The void space is positioned 3 mm from the foremost face of the fuel element and extends towards the base end of the fuel element. Two grooves of 0.4 mm width and 1 mm depth extend across the front face of the fuel element. The fuel element weighs about 117 mg, and has a density of about 1.8 g/cc as determined using a helium pycnometer. No longitudinally extending air passageways extend completely through either of the burning or base portions of the fuel element.

The fuel element is provided by extruding a paste of tobacco dust, hardwood pulp carbon and sodium carboxymethylcellulose binder available as Hercules 7HFSCMC from Hercules Inc.

The hardwood pulp carbon is prepared by carbonizing a non-talc containing grade of Grand Prairie Canadian Kraft hardwood paper under nitrogen blanket, increasing the temperature in a step-wise manner sufficient to minimize oxidation of the paper, to a final carbonizing temperature of at least 750° C. The resulting carbon material is cooled under nitrogen to less than 35° C., and then ground to a fine powder having an average particle size of about 4 to about 6 microns in diameter.

About 74 parts of the finely powdered hardwood carbon is admixed with about 20 parts fine tobacco dust and about 6 parts of the sodium carboxymethylcellulose binder, and sufficient water to provide a mixture having a stiff, dough-like paste form.

Fuel elements are extruded from the paste using a ram extruder. The resulting extrudate is air dried. The extrudate then is cut into sections of 4 mm lengths, thereby providing a plurality of fuel elements.

Retaining Member For Fuel Element

A small cup is manufactured from deep drawn aluminum sheet having a thickness of about 0.004 inch. The cup has sealed sides and bottom, and has an open top. The height of the cup is about 2.9 mm. Two sides of the cup are parallel to one another such that the width of the cup is about 6.5 mm. Two sides of the cup are circular such that the maximum width of the cup is about 7.5 mm.

The fuel element is positioned in the cup so that the face of the base of fuel element rests on the inner bottom face of the cup. The face of the base of the fuel element is parallel to the extrusion axis of the fuel element (i.e., the extrusion axis of the fuel element is perpendicular to the longitudinal axis of the ultimate cigarette). The parallel sides of the cup then are crimped over portions of the front face of the respective base segments of the fuel element so as to hold the fuel element securely in place within the cup.

Heat Conductive Cartridge and Aerosol Generating Means

A cylindrical cartridge is manufactured from deep drawn aluminum sheet having a thickness of about 0.004 inch. The cartridge has a circular cross-sectional shape having an inner diameter of about 7.2 mm. One end of the cartridge is open; and the other end is sealed and an opening of about 1.5 mm diameter is punched through the bottom face of the cartridge. The cartridge has a length of about 14 mm.

Into the cartridge is placed 325 mg of aerosol forming material and substrate therefor. The substrate and aerosol forming material include about 3.7 percent fructose, about 11 percent of a spray dried aqueous tobacco extract in powder form, about 20 percent glycerin, about 0.1 percent chocolate flavor oil, and about 65.2 percent alpha alumina beads available as D-2 Sintered Alpha Alumina from W. R. Grace & Co. The beads have a surface area of about 4 $m^2/g$ to about 8 $m^2/g$ as determined using the BET method, and have a size from −14 to +20 mesh (U.S.).

Into the cartridge is inserted the retaining member such that the fuel element held in place by the retaining member extends about 1 mm beyond the front of the cartridge. The retaining member is held firmly in place within the cartridge by a friction fit.

Mouthend Piece and Assembly of the Cigarette

A tube of about 78 mm length and about 7.7 mm diameter is made from a web of paper about 27 mm wide. The paper is a 76 lb. Mouthpiece Paper having a thickness of about 0.012 inch, and is available from Simpson Paper Co. The paper is formed into a tube by lap-joining the paper using a water-based ethylene vinyl acetate adhesive.

Into one end of the paper tube is inserted the cartridge such that the front fact of the fuel element is flush with the front end of the paper tube. As a result, the extrusion axis of the fuel element is perpendicular to the longitudinal axis of the cigarette. The cartridge is held in place securely within the paper tube by friction fit.

Into the opposite end of the paper tube is inserted a cylindrical filter element. The filter element has a length of about 10 mm and a circumference of about 24 mm. The filter element is provided using known filter making techniques from cellulose acetate tow (8.0 denier per filament; 40,000 total denier) and circumscribing paper plug wrap.

The cigarette is smoked, and yields visible aerosol and tobacco flavor (i.e., volatilized tobacco components) on all puffs for about 10 puffs.

EXAMPLE 2

Cigarettes of the type illustrated in FIG. 1 are manufactured essentially as described in Example 1, except that the following fuel elements are employed:

A segmented fuel element has base, isolation and burning portions; and an overall length of about 7 mm. The fuel element has the shape shown generally in FIG. 11. The longitudinal length of the base portion is about 2 mm, the longitudinal length of the isolation portion is about 2 mm, and the longitudinal length of the burning portion is about 3 mm. The cross sectional shape of the base portion is rectangular, and the base portion is about 5.6 mm high and about 4 mm wide. The cross sectional outer dimensions of the isolation portion increase from the burning portion toward the base portion. The cross sectional shape of the burning portion is square, and the burning portion is about 4 mm high and about 4 mm wide. The fuel element includes a void space having a triangular shape, extending about 2.5 mm longitudinally and 2.2 mm across. The tip of the triangular void space is positioned 3 mm from the foremost face of the fuel element and extends towards the base end of the fuel element. The fuel element weighs about 109 mg, and has a density of about 1.8 g/cc as determined using a helium pycnometer. No longitudinally extending air passageways extend completely through either of the burning or base portions of the fuel element.

The fuel element is provided by extruding a paste of tobacco dust, hardwood pulp carbon and sodium carboxymethylcellulose binder available as Hercules 7HFSCMC from Hercules Inc.

The hardwood pulp carbon is prepared as described in Example 1.

About 90 parts of the finely powdered hardwood carbon is admixed with about 10 parts of the sodium carboxymethylcellulose binder, and sufficient water to provide a mixture having a stiff, dough-like paste form.

Fuel elements are extruded from the paste using a ram extruder. The resulting extrudate is air dried. The extrudate then is cut into sections of about 4 mm lengths, thereby providing a plurality of fuel elements.

The cigarette is smoked under FTC smoking conditions. The cigarette yields about 0.7 mg glycerin over the first 3 puffs, and about 0.8 mg glycerin over the second 3 puffs. The cigarette yields visible aerosol and tobacco flavor on all puffs for about 13 puffs. The cigarette exhibits a pressure drop of about 65 mm $H_2O$ at 7.5 cc/sec air flow rate as measured using a Filtrona Filter Test Station (CTS Series) available from Filtrona Instruments and Automation Ltd.

EXAMPLE 3

Cigarettes are manufactured as described in Example 2, except that the following substrate materials and aerosol forming material are employed:

The cartridge contains two segments of substrate materials. One segment, positioned immediately behind the retaining member, consists of about 140 mg of the alumina beads and aerosol forming material described in Example 1. A second segment, positioned behind the alumina beads, consists of glycerin carried by a gathered paper wrapped in a paper wrapper. The gathered paper has a generally cylindrical shape and is about 3.3 mm in length and about 23.2 mm in circumference. The longitudinal axis of the cylindrical paper substrate is parallel to the longitudinal axis of the cigarette. The gathered paper is available as MS2408/S538 from Filtrona, Ltd., and is gathered into a segment weighing about 25 mg. About 45 mg of glycerin is added to the gathered paper.

The cigarette is smoked, and yields visible aerosol and tobacco flavor (i.e., volatilized tobacco components) on all puffs for about 13 puffs. The cigarette exhibits a pressure drop of about 90 mm $H_2O$ at 17.5 cc/sec using the device described in Example 2.

EXAMPLE 4

Cigarettes of the type illustrated in FIG. 17 are manufactured in the following manner:

Fuel Element Preparation

A segmented fuel element has base, isolation and burning portions; and an overall length of about 14 mm.

The longitudinal length of the base portion is about 3 mm, the longitudinal length of the isolation portion is about 8 mm, and the longitudinal length of the burning portion is about 3 mm. The cross sectional shape of the base portion is circular, and the base portion is about 4.5 mm in diameter. The isolation portion is generally rectangular in cross sectional shape and the isolation portion is about 4.5 mm wide and about 2 mm thick. The cross sectional shape of the burning portion is circular, and the burning portion is about 4.5 mm in diameter. The fuel element includes 2 grooves formed along the entire length of the fuel element, positioned on each side of the fuel element about 180° apart. Each groove is about 0.75 mm wide and about 1.5 mm deep. The fuel element weighs about 163 mg, and has a density of about 1.8 g/cc as determined using a helium pycnometer.

The fuel element is provided by extruding a paste of tobacco dust, hardwood pulp carbon and sodium carboxymethylcellulose binder available as Hercules 7HXFCMC from Hercules Inc.

The hardwood pulp carbon is provided generally as described in Example 1, and is ground to a fine powder having an average particle size of about 10 to about 14 microns in diameter.

About 72 parts of the finely powdered hardwood carbon is admixed with about 20 parts fine tobacco dust and about 8 parts of the sodium carboxymethylcellulose binder, and sufficient water to provide a mixture having a stiff, dough-like paste form. The tobacco dust is provided by ball milling an "American Blend" of tobacco cut filler to a particle size of about 12 microns in diameter.

Fuel elements are extruded from the paste using a ram extruder. The extrusion axis of the extrudate is such that the extrusion axis of the resulting fuel element is parallel to the longitudinal axis of the cigarette into which the fuel element is incorporated. The extrudate is extruded so that 2 grooves extend along its length. The resulting extrudate is air dried. The dried extrudate then is cut into sections of 14 mm lengths, thereby providing a plurality of fuel elements. The fuel elements are machined using a diamond cutting wheel to provide the isolation segment.

Front End Preparation

The fuel element is circumscribed by glass fibers of the type described in pages 48–52 of *Chemical and Biological Studies of New Cigarette Prototypes That Heat Instead of Burn Tobacco,* R. J. Reynolds Tobacco Co. publication (1988). The glass fibers are in turn circumscribed by a paper wrapper available as P-850-63-5 from Kimberly-Clark Corp. so as to provide a cylinder having open ends for the passage of air therethrough, a length of about 14 mm and a circumference of about 7.5 mm.

Substrate Preparation

A rod of gathered filter paper available as MS2408/S538 from Filtrona, Ltd. is cut to a segment having a length of about 5 mm, and a length of about 3 mm and a diameter of about 3 mm is punched therefrom through the center of the segment. The segment has a dry weight of about 55 mg, and about 125 mg glycerin is added to the substrate.

Mouthend Piece

A tube of about 63 mm length and about 7.5 mm diameter is made from a web of paper about 27 mm wide. The paper is a 76 lb. Mouthpiece Paper having a thickness of about 0.012 inch, and is available from Simpson Paper Co. The paper is formed into a tube by lap-joining the paper using a water-based ethylene vinyl acetate adhesive. The inner surface of the tube is coated with Hercon 70 from Hercules, Inc. about 10 mm into the tube and allowed to dry. Then, the coated inner surface of the tube is coated with an aqueous solution of calcium chloride, and allowed to dry.

Into the coated end of the paper tube is inserted the substrate such that the front face of the substrate is about 3 mm from the front end of the paper tube. The substrate is held in place securely within the paper tube by friction fit.

Into the opposite end of the tube is inserted a 10 mm length segment of tobacco cut filler wrapped in a circumscribing paper wrapper. The segment is inserted into the tube so that the back end of the segment is about 10 mm from the extreme mouth end of the tube.

Into the end of the paper tube opposite the substrate is inserted a cylindrical filter element so as to abut the segment of tobacco cut filler. The filter element has a length of about 10 mm and a circumference of about 24 mm. The filter element is provided using known filter making techniques from cellulose acetate tow (8.0 denier per filament; 40,000 total denier) plasticized using triacetin, and circumscribing paper plug wrap.

Assembly of the Cigarette

The mouthend piece and front end are positioned in an abutting, end-to-end relationship, such that the front face of the substrate is positioned about 3 mm from the back face of the fuel element. The front end and mouthend pieces are held together by a circumscribing paper wrapper which acts as a tipping paper. The paper wrapper is a low porosity paper and available as P-850-61-2 from Kimberly-Clark Corp., and circumscribes the entire length of the front end piece except for about a 3 mm length of the front end piece at the extreme lighting end thereof.

The cigarette contains no metallic heat conducting cartridge, no metallic retaining means and no metallic substrate components. The fuel element is held firmly in place within the cigarette by the insulating glass fibers which surround the fuel element.

The cigarette is smoked, and yields visible aerosol and tobacco flavor (i.e., volatilized tobacco components) on all puffs for about 10 puffs. The fuel element burns to about the region thereof where the burning portion meets the isolation portion, and the cigarette self-extinguishes.

EXAMPLE 5

Cigarettes are manufactured as described in Example 4, except that the following configuration and substrate materials are employed:

The substrate has essentially the same dimensions as described in Example 4, except that the portion having the length of about 5 mm is provided as a tube of wound paper available as P-1981-152 from Kimberly-Clark Corp.; and the inner segment having a length of about 2 mm and a diameter of about 3 mm is provided by gathering a paper available as P-780-63-5 from Kimberly-Clark Corp.

The front-end piece is provided by circumscribing the fuel element and glass fibers with the paper available as P-850-63-5 from Kimberly-Clark Corp., and then circumscribing that with the paper available as P-850-61-2 from Kimberly-Clark Corp. except for about a 3 mm length of the front-end piece at the extreme lighting end thereof.

A tube of the mouthpiece paper from Simpson Paper Co., having a length of about 74 mm, is inserted over the front-end piece so as to expose the foremost 3 mm of the front-end piece, and is held in place by friction fit. The inner surface of the tube is coated using materials and techniques in Example 4. The substrate is positioned within the tube so that the back face of the fuel element and the front face of the substrate are about 3 mm apart.

The remaining components of the cigarette are provided, essentially as described in Example 4.

The cigarette is smoked, and yields visible aerosol and tobacco flavor (i.e., volatilized tobacco components) on all puffs for about 10 puffs. The fuel element burns to about the region thereof where the burning portion meets the isolation portion, and the cigarette self-extinguishes.

What is claimed is:

1. A cigarette comprising:
(a) a combustible fuel element having a portion which burns during use and a portion which does not burn during use;
(b) aerosol generating means (i) physically separate from, longitudinally adjacent, and in a heat exchange relationship with, the fuel element, and (ii) including a paper substrate;
(c) a mouthend piece; and
(d) tobacco.

2. The cigarette of claim 1, wherein the portion of the fuel element which burns during use comprises a burning segment of the fuel, the portion which does not burn during use comprises a base segment of the fuel, and the burning segment is physically different from the base segment.

3. The cigarette of claim 2, wherein the fuel element further includes an isolation segment positioned between the burning and base segments, and the burning and base segments are physically different from the isolation segment.

4. The cigarette of claim 3 wherein the fuel element has a total length, prior to burning, of less than about 20 mm.

5. The cigarette of claim 3 wherein the fuel element includes at least one transversely extending void space.

6. The cigarette of claim 3 wherein the fuel element is secured in place within the cigarette by a material which circumscribes the longitudinal periphery of the fuel element.

7. The cigarette of claim 1, further comprising retaining means securing the fuel element in position within the smoking article.

8. The cigarette of claim 7, wherein the paper substrate comprises gathered paper wrapped in a circumscribing paper wrapper, and is positioned adjacent the back end of the retaining means.

9. The cigarette of claim 7 or 8, further comprising an enclosure member which contacts a portion of the aerosol generating means and a portion of the retaining means.

10. The cigarette of claim 1, wherein the paper substrate comprises a segment of gathered paper being positioned within a tube at the end of the tube near the back end of the fuel element.

11. The cigarette of claim 10, the aerosol generating means further having an void space behind the gathered paper segment.

12. A cigarette having a longitudinal axis and comprising
(a) an extruded fuel element having an extrusion axis, the fuel element being a longitudinally segmented combustible fuel element having a burning segment and a base segment, and the fuel element being positioned within the cigarette such that the extrusion axis of the fuel element is substantially perpendicular to the longitudinal axis of the cigarette;
(b) aerosol generating means (i) physically separate from, longitudinally disposed from, and in a heat exchange relationship with, the fuel element, and (ii) including a paper substrate carrying at least one aerosol forming material;
(c) retaining means circumscribing and contacting the longitudinal periphery of the fuel element to secure the fuel element in position within the cigarette;
(d) a mouthend piece; and
(e) tobacco.

13. The cigarette of claim 12, wherein the fuel element further includes an isolation segment positioned between the burning and base segments, and the burning and base segments are physically different from the isolation segment.

14. The cigarette of claim 13 wherein the fuel element has a total length, prior to burning, of less than about 20 mm.

15. The cigarette of claim 13 wherein the fuel element includes at least one void space extending therethrough in a direction transverse to the longitudinal axis of the cigarette.

16. The cigarette of claim 12 or 7, wherein the retaining means is a fibrous retaining means which extends over substantially the whole longitudinal periphery of the fuel element.

17. A smoking article comprising:
(a) a longitudinally segmented combustible fuel element having a burning segment and a base segment;
(b) aerosol generating means (i) physically separate from, longitudinally disposed from, and in a heat exchange relationship with, the fuel element, and (ii) including a paper substrate; and
(c) retaining means circumscribing the fuel element and securing the fuel element in position within the smoking article.

18. The smoking article of claim 17, wherein the fuel element further includes an isolation segment positioned between the burning and base segments, and the burning base segments are physically different from the isolation segment.

19. The smoking article of claim 18 wherein the fuel element has a total length, prior to burning, of less than about 20 mm.

20. The smoking article of claim 18 wherein the fuel element includes at least one transversely extending void space.

21. The smoking article of claim 17 wherein the fuel element includes tobacco.

22. The smoking article of claim 17 wherein the retaining means is a material which circumscribes and contacts the longitudinal periphery of the fuel element.

23. A smoking article having a longitudinal axis and comprising (a) an extruded fuel element having an extrusion axis, the fuel element being a longitudinally segmented combustible fuel element having a burning segment and a base segment, and the fuel element being positioned within the cigarette such that the extrusion axis of the fuel element is substantially perpendicular to the longitudinal axis of the cigarette;

(b) aerosol generating means (i) physically separate from, longitudinally disposed from, and in a heat exchange relationship with, the fuel element, and (ii) including a paper substrate carrying at least one aerosol forming material; and (c) retaining means for securing the fuel element in position within the smoking article.

24. The smoking article of claim 23, wherein the fuel element further includes an isolation segment positioned between the burning and base segments, and the burning and base segments are physically different from the isolation segment.

25. The smoking article of claim 24 wherein the fuel element has a total length, prior to burning, of less than about 20 mm.

26. The smoking article of claim 24 wherein the fuel element includes at least one void space extending therethrough in a direction transverse to the longitudinal axis of the smoking article.

27. The smoking article of claim 23 including a the mouthend piece having a generally tubular shape and tobacco in the form of a cut filler; and a roll of tobacco cut filler is positioned in the mouthend piece.

28. The smoking article of claim 23 wherein the fuel element includes tobacco.

29. The smoking article of claim 23 wherein the retaining means is a material which circumscribes and contacts the longitudinal periphery of the fuel element.

30. The cigarette of claim 1 or 12, wherein the paper substrate comprises carbon paper or tobacco paper.

31. The smoking article of claim 17 or 23, wherein the retaining means is a fibrous retaining means which extends over substantially the whole longitudinal periphery of the fuel element.

32. The smoking article of claim 17 or 23, wherein the paper substrate comprises carbon paper or tobacco paper.

33. A cigarette comprising:

(a) a longitudinally segmented combustible fuel element;

(b) aerosol generating means (i) physically separate from, longitudinally disposed from, and in a heat exchange relationship with, the fuel element, and (ii) including a substrate comprising a gathered web;

(c) a mouthend piece; and (d) tobacco.

34. A smoking article comprising:

(a) a longitudinally segmented combustible fuel element;

(b) aerosol generating means (i) physically separate from, longitudinally disposed from, and in a heat exchange relationship with, the fuel element, and (ii) including a substrate comprising a gathered web; and (c) retaining means circumscribing the fuel element and securing the fuel element in position within the smoking article.

35. A cigarette comprising a) a combustible fuel element less than 20 mm in length prior to smoking;

b) an aerosol generating means including a paper substrate carrying an aerosol forming material which is longitudinally spaced about 1 to 10 mm from the fuel element; and c) a non-metallic retaining member circumscribing the fuel element and contacting the entire longitudinal periphery of the fuel element, for retaining the fuel element within the cigarette.

36. The cigarette of claim 35, further including a non-burning wrapper circumscribing the retaining material which is spaced at least about 2 mm from the lighting end of the fuel element.

37. The cigarette of claim 35, wherein the fuel element provides less than about 300 calories under FTC smoking conditions.

38. The cigarette of claim 35, wherein the material circumscribing the fuel element is a fibrous material.

39. The cigarette of claim 38, wherein the fibrous material comprises glass fibers, tobacco cut filler, tobacco paper, carbon paper, or a tobacco filler/glass fiber mixture.

40. The cigarette of claim 35, wherein the material circumscribing the fuel element comprises a gathered or shredded paper material.

41. The cigarette of claim 38 or 40, wherein the material circumscribing the fuel element is non-burning.

42. The cigarette of claim 41, wherein the non-burnable material is a metal foil or paper treated with a burn retardant.

43. The cigarette of claim 40, wherein the paper material circumscribing the fuel element contains carbon.

44. The cigarette of claim 40, wherein the paper material circumscribing the fuel element is a tobacco-containing paper.

45. The cigarette of claim 38, wherein the migration resistant material comprises calcium chloride, ethyl cellulose, diammonium orthophosphate, or Hercon 70.

46. A cigarette comprising a) a combustible fuel element less than 20 mm in length prior to smoking;

b) an aerosol generating means including a paper substrate carrying an aerosol forming material which is longitudinally spaced about 1 to 10 mm from the fuel element; and c) material circumscribing the fuel element for retaining the fuel element within the cigarette;

the material circumscribing the fuel element consisting essentially of insulating material.

47. The cigarette of claim 46, wherein the paper substrate is spaced about 2 to 5 mm from the fuel element.

48. The cigarette of claim 35 or 46, wherein the paper substrate is a gathered web.

49. The cigarette of claim 48, wherein the weight of the aerosol forming material carried by the substrate is about 2 to 4 times the dry weight of the paper substrate.

50. The cigarette of claim 49, wherein the paper substrate is circumscribed by a material which limits the migration of the aerosol forming material from the substrate.

51. The cigarette of claim 35 or 46 wherein the paper substrate comprises a tobacco containing material.

52. The cigarette of claim 46, wherein the fuel element provides less than about 250 calories under FTC smoking conditions.

53. A cigarette comprising:

(a) a combustible fuel element;

(b) physically separate aerosol generating means comprising a paper substrate and an aerosol forming material;
(c) a mouthend piece, and
(d) a non-metallic retaining member circumscribing the fuel element and contacting the entire longitudinal periphery of the fuel element, for retaining the fuel element within the cigarette; and
(e) a non-burnable material which circumscribes at least a portion of the longitudinal periphery of the fuel element, the non-burnable material being longitudinally spaced about 2 mm to about 8 mm from the lighting end of the fuel element.

54. The cigarette of claim 53, further comprising an ignitable material which circumscribes at least a portion of the longitudinal periphery of the fuel element.

55. The cigarette of claim 53, wherein the non-burnable material is spaced about 3 mm to about 6 mm from the lighting end of the fuel element.

56. A cigarette comprising:
(a) a combustible fuel element;
(b) a non-metallic retaining member circumscribing the fuel element and contacting the entire longitudinal periphery of the fuel element, for retaining the fuel element within the cigarette;
(c) physically separate aerosol generating means comprising a substrate and an aerosol forming material, at least a portion of the periphery of the substrate being circumscribed by a material which resists migration of aerosol forming material prior to smoking; and
(d) a mouthend piece.

57. The cigarette of claim 56, wherein the migration resistant material comprises calcium chloride, ethyl cellulose, diammonium hydrogen orthophosphate, or Hercon 70.

58. The cigarette of claim 1, wherein the paper substrate comprises gathered paper wrapped in a circumscribing paper wrapper.

59. A cigarette comprising:
(a) a combustible fuel element having a portion which burns during use and a portion which does not burn during use;
(b) aerosol generating means (i) physically separate from, longitudinally adjacent, and in a heat exchange relationship with, the fuel element, and (ii) including a paper substrate;
(c) at least a portion of the fuel element and at least a portion of the aerosol generating means being circumscribed by a paper which exhibits the propensity not to burn during use of the cigarette,
(d) a mouthend piece; and
(e) tobacco.

60. The cigarette of claim 59, wherein the non-burning paper has a porosity which is too low to support combustion.

61. The cigarette of claim 59, wherein the non-burning paper is chemically treated to prevent combustion.

62. The cigarette of claim 59, wherein the paper substrate is circumscribed with a non-metallic material which resists migration.

63. The cigarette of claim 62, wherein the migration resisting material comprises ethyl cellulose or Hercon 70.

64. The cigarette of claim 59, wherein the paper substrate is circumscribed by a paper coated with calcium chloride.

65. A cigarette comprising:
(a) a combustible fuel element less than 20 mm in length prior to smoking;
(b) an aerosol generating means including a paper substrate carrying an aerosol forming material which is longitudinally spaced about 1 to 10 mm from the fuel element; and
(c) a non-metallic retaining member circumscribing the fuel element and contacting the entire longitudinal periphery of the fuel element, for retaining the fuel element within the cigarette.

66. The cigarette of claim 65, wherein the material circumscribing the fuel element consists essentially of insulating material.

67. The cigarette of claim 65, wherein the paper substrate is a gathered web.

68. The cigarette of claim 65, wherein the weight of the aerosol forming material carried by the substrate is about 2 to 4 times the dry weight of the substrate.

69. The cigarette of claim 65, wherein the substrate is circumscribed by a material which limits the migration of the aerosol forming material from the substrate.

70. The cigarette of claim 69, wherein the material which resists migration comprises paper bearing a migration-resistant coating.

71. The cigarette of claim 65, further including a non-burning wrapper circumscribing the non-metallic retaining member, the non-burning wrapper being spaced at least about 2 mm from the lighting end of the fuel element.

72. The cigarette of claim 65, 67 or 69 wherein the paper substrate comprises carbon or tobacco.

73. The cigarette of claim 65, wherein the non-metallic retaining member is a fibrous material comprising glass fibers, tobacco cut filler, tobacco paper, carbon paper or a tobacco filler/glass fiber mixture.

74. The cigarette of claim 65, wherein the material circumscribing the fuel element comprises a gathered or shredded paper material.

75. The cigarette of claim 74, wherein the paper material circumscribing the fuel element contains carbon, tobacco or mixtures thereof.

76. The cigarette of claim 65, wherein the material circumscribing the fuel element is non-burning.

77. A cigarette comprising:
(a) a combustible fuel element;
(b) a physically separate aerosol generating means comprising a substrate and an aerosol forming material;
(c) a mouthend piece;
(d) a non-metallic retaining member circumscribing the fuel element and contacting the entire longitudinal periphery of the fuel element, for retaining the fuel element within the cigarette; and
(e) a non-burnable material which circumscribes at least a portion of the longitudinal periphery of the fuel element, the non-burnable material being longitudinally spaced about 2 mm to about 8 mm from the lighting end of the fuel element.

78. The cigarette of claim 71 or 77, wherein the non-burnable material is a metal foil or paper treated with a burn retardant.

79. The cigarette of claim 77, further comprising an ignitable material which circumscribes at least a portion of the longitudinal periphery of the fuel element.

80. A cigarette comprising:
(a) a combustible fuel element;
(b) a non-metallic retaining member circumscribing the fuel element and contacting substantially the entire longitudinal periphery for retaining the fuel element within the cigarette;

(c) physically separate aerosol generating means comprising a substrate and an aerosol forming material, at least a portion of the periphery of the substrate being circumscribed by a material which resists migration of aerosol forming material prior to smoking; and (d) a mouthend piece.

* * * * *